US005485523A

United States Patent [19]

Tamamura et al.

[11] Patent Number: 5,485,523

[45] Date of Patent: Jan. 16, 1996

[54] ACTIVE NOISE REDUCTION SYSTEM FOR AUTOMOBILE COMPARTMENT

[75] Inventors: Manpei Tamamura, Oota; Hiroshi Iidaka, Koganei; Kazuyuki Kondo, Oota; Keitaro Yokota, Hoya, all of Japan

[73] Assignees: Fuji Jukogyo Kabushiki Kaisha, both of Tokyo; Pioneer Electronic Corporation, Tokyo, Japan

[21] Appl. No.: 32,057

[22] Filed: Mar. 16, 1993

[30] Foreign Application Priority Data

| | | | |
|---|---|---|---|
| Mar. 17, 1992 | [JP] | Japan | 4-060202 |
| Mar. 24, 1992 | [JP] | Japan | 4-066338 |
| Apr. 3, 1992 | [JP] | Japan | 4-082325 |
| Apr. 3, 1992 | [JP] | Japan | 4-082326 |

[51] Int. Cl.[6] ..... G10K 11/16

[52] U.S. Cl. ..... 381/71; 381/86

[58] Field of Search ..... 381/71, 86, 72, 381/94

[56] References Cited

U.S. PATENT DOCUMENTS

| | | | |
|---|---|---|---|
| 4,953,219 | 8/1990 | Kasai et al. | 381/86 |
| 5,131,047 | 7/1992 | Hashimoto et al. | 381/71 |

FOREIGN PATENT DOCUMENTS

| | | | |
|---|---|---|---|
| 0098594 | 1/1984 | European Pat. Off. . | |
| 0479367 | 4/1992 | European Pat. Off. . | |
| 2203016 | 11/1988 | United Kingdom | 381/71 |
| 2230920 | 10/1990 | United Kingdom . | |

*Primary Examiner*—Forester W. Isen

*Attorney, Agent, or Firm*—Beveridge, DeGrandi, Weilacher & Young

[57] ABSTRACT

In an automobile compartment noise reduction system, an ignition signal transforming circuit processes an ignition pulse signal to obtain a vibration noise source signal with a frequency spectrum composed of 0.5×n (integers) order components of the engine r.p.m. as the primary source signal. The signal is applied to an adaptive filter and an LMS calculating circuit via a speaker-microphone transmission characteristic correcting circuit. The primary source signal is synthesized by the filter into a cancel signal and then outputted through a speaker as canceling sound. The canceling sound is received by at least one error microphone at a noise receiving point as an error signal. The error signal is applied to the LMS calculating circuit. The LMS circuit updates the filter coefficients of the adaptive filter on the basis of the primary source signal and the error signal so that the error signal can be minimized. The noise reduction system has high reliability with low cost, and is easy to mount.

24 Claims, 18 Drawing Sheets

| | INPUT SIGNAL | OUTPUT SIGNAL | SOUND |
|---|---|---|---|
| (I) | 24 PULSES<br>720 °CA<br>t | 720°CA<br>a<br>-2a<br>t<br>⇔<br>(FREQ. RANGE)<br>NO 1.5 × n ORDER COMPONENTS<br>1.0 2.0 3.0 4.0 5.0 6.0 7.0 8.0 f | 3-CYL. ENG. SOUND WITHOUT CANCELING 1.5n ORDER COMP. SOUND |
| (II) | DITTO | 720 °CA<br>a<br>-3a<br>t<br>⇔<br>(FREQ. RANGE)<br>NO 2.0×n ORDER COMPONENTS<br>1.0 2.0 3.0 4.0 5.0 6.0 7.0 8.0 f | 4-CYL. ENG. SOUND WITHOUT CANCELING 2.0n ORDER COMP. SOUND |
| (III) | DITTO | 720°CA<br>a<br>-5a<br>t<br>⇔<br>(FREQ. RANGE)<br>NO 3.0 × n ORDER COMPONENTS<br>1.0 2.0 3.0 4.0 5.0 6.0 7.0 f | 6-CYL. ENG. SOUND WITHOUT CANCELING 3.0n ORDER COMP. SOUND |
| (IV) | DITTO | 720°CA<br>a<br>-7a<br>t<br>⇔<br>(FREQ. RANGE)<br>NO 4.0 × n ORDER COMPONENTS<br>1.0 2.0 3.0 4.0 5.0 6.0 7.0 8.0 f | 8-CYL. ENG. SOUND WITHOUT CANCELING 4.0n ORDER COMP. SOUND |

FIG. 18

FIG. 19(A)
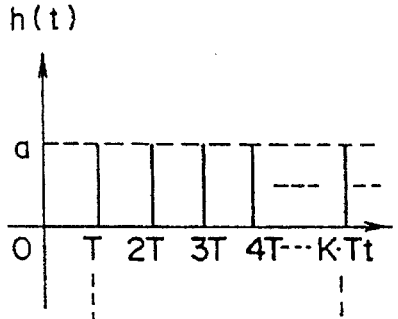
FIG. 19(A')
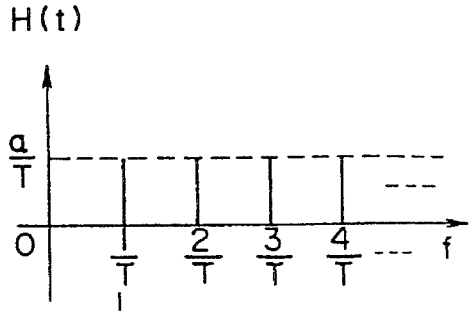
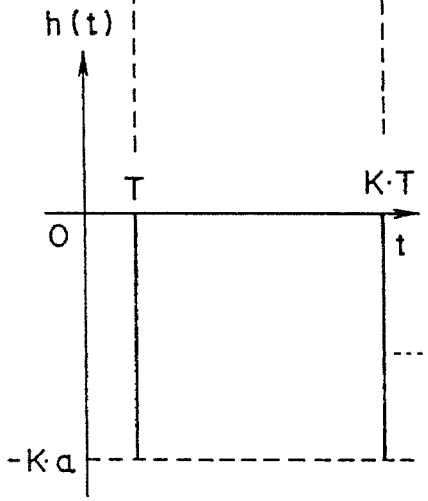
FIG. 19(B)
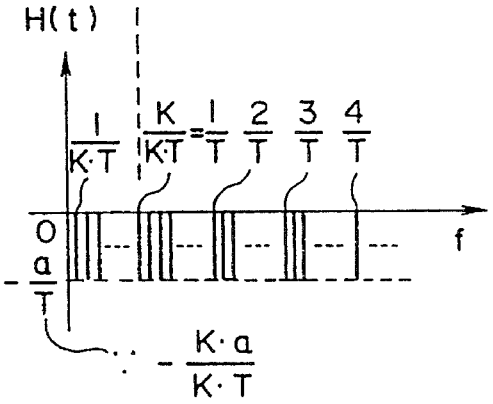
FIG. 19(B')
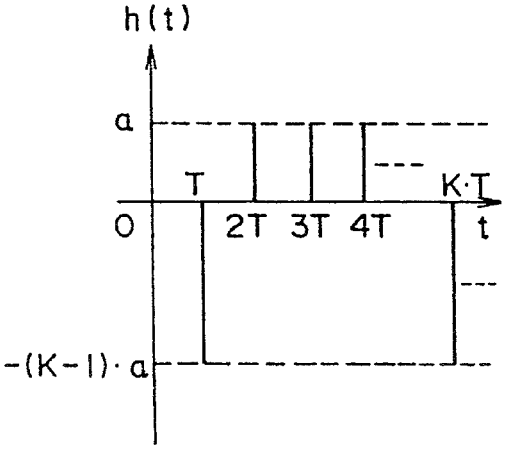
FIG. 20(C)
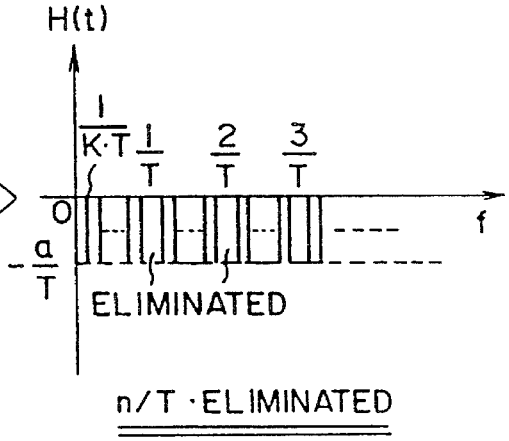
FIG. 20(C')

ACTIVE NOISE REDUCTION SYSTEM FOR AUTOMOBILE COMPARTMENT

BACKGROUND OF THE INVENTION

The present invention relates to a noise reduction system within a passenger compartment of an automotive vehicle, by positively generating sound for canceling the noise within the passenger compartment.

There has been proposed a technique for reducing noise generated mainly by engine vibration and transmitted to the passenger compartment, by generating canceling sound from an additional sound source. The amplitude of the canceling sound is the same as that of the engine noise, but the canceling sound has a reversed phase with respect to the engine noise.

A noise reduction system of the prior art is disclosed in Japanese Laid-Open Patent Application No. 3-5255. In this prior art noise reduction system for generating canceling sound, the numerical data representative of the fundamental sine waves out of phase but in synchronism with the secondary order components of the number engine revolution are previously stored; and the phases and amplitudes of the fundamental sine waves are corrected on the basis of the number of engine revolutions detected by a crank angle sensor and the engine load detected by a pressure sensor, without directly detecting engine vibrations by any engine vibration sensor.

In the prior art system as described above, a great number of data must be stored in order to reduce various noise waveforms generated under various engine operating conditions, so that it is difficult to reduce engine vibration noise stably under various engine operating conditions. Further, since the noise generated by an engine is different according to the transmission characteristics of the respective vehicle bodies, the above-mentioned data must be stored individually according to the respective vehicles.

On the other hand, recently, another noise reduction system has been practically used, in which an LMS (least means square) algorithm is adopted on the basis of a theory such that a mean square error can be approximated by an instantaneous square error on the basis of the fact that the filter correcting equations are recursive equations, in order to simplify the calculating equations for obtaining optimum filter coefficients. Further, another noise reduction system has been put into the market, in which there is adopted an MEFX (Multiple Error Filtered X) algorithm obtained by expanding the LMS algorithm to a multichannel system. In this prior art passage compartment noise reduction system based upon the LMS algorithm, in order to reduce passage comportment noise mainly generated by engine vibration, a noise vibration source signal high in correlation to the engine vibration, that is, the primary source signal, is detected with the use of a vibration sensor; a cancel sound signal for reducing the noise is synthesized on the basis of passing the primary source signal through an adaptive filter; and the synthesized signal is generated from a speaker. Further, the noise reduction status at a noise receiving point is detected by an error microphone to obtain an error signal, and further the filter coefficients of the adaptive filter are updated in accordance with an LMS algorithm on the basis of the error signal and the primary source signal, so that the noise can be minimized at the noise receiving point.

In the above-mentioned noise reduction system using the LMS algorithm, it is possible to stably reduce noise under various operating conditions without storing a great number of data, and additionally various engine noises different from each other can be effectively reduced according to individual vehicle bodies.

In this prior art system, however, an engine vibration sensor is additionally required to detect a signal high in correlation to the engine vibration. Further, in order to obtain a primary source signal, the vibration sensor must be high in precision and reliability, thus raising a problem in that the noise reduction system is high in cost. Further, it is rather difficult to newly mount the noise reduction system on the automotive vehicle provided with no such system.

On the other hand, Japanese Laid-Open (Kokai) Patent Application No. 63-315346 discloses such a technology that engine revolution speed is detected on the basis of the intervals of the ignition signal; canceling sound previously determined for each engine revolution speed is retrieved; and the retrieved canceling sound is outputted through a speaker. On the other hand, bass sound within the passenger compartment is detected by a microphone disposed at a noise receiving position; the current bass sound is compared with the preceding bass sound; when the current bass sound is low (or high) in input level, the current canceling sound is advanced (or delayed) in phase or amplified at a high (or low) amplification factor before being outputted through the speaker, so that the bass sound detected by the microphone can be minimized.

In this prior art technology, however, since the engine revolution speed fluctuates always during vehicle traveling, and violently in particular during transient engine operation, even if an appropriate canceling sound is outputted for each engine speed range, the waveform of output of the canceling sound signal is not continuous, so that abnormal noise is inevitably produced when the canceling sound is not connected smoothly at good timing.

To overcome this problem, Japanese Laid-Open Patent Application No. 3-90448 proposes a technique for preventing abnormal sound from being generated by providing a wait time at which the canceling sound is not outputted, so that the canceling sound can be connected smoothly before and after the fluctuations of the engine speed.

In this prior art bass sound reducing technique, however, since bass sound during transient engine operation is not securely reduced, when the vehicle is started, bass sound caused by the engine is transmitted directly into the car room. In addition, when the vehicle is shifted to a constant speed travel, since the bass sound is canceled by the canceling sound generated by the speaker, there exists a problem in that the bass sound is reduced or generated according to the vehicle operating conditions and therefore the passenger does not feel pleasant.

In addition, in order to effectively reduce noise by the passenger compartment noise reduction system using the LMS algorithm, it is necessary to accurately determine the speaker-microphone transmission characteristics Cmn subjected to the influence of passenger's seat taking conditions, room temperature, room humidity, and the change thereof with the passage of time. Therefore, in the conventional method, the passenger is requested to previously determine the transmission characteristics Cmn by identifying the system after the passenger takes a seat-and before the noise reduction system is activated.

However, this operation is troublesome. Further, when random noise is generated whenever the system identification is executed, the random noise provides an unpleasant feeling to the passenger.

To overcome the above-mentioned problem, it may be possible to consider that the fixed speaker-microphone transmission characteristics can be determined in accordance with experimental results, in order to eliminate the troublesome work and the unpleasant feeling to the passengers. In this case, however, there exists another problem in that the speaker-microphone transmission characteristics deviate from the actual transmission characteristics due to the change in various environment conditions with the passage of time and the arrangement of appliances such as the cushions, accessories, child seats, etc. That is, even if the speaker-microphone transmission characteristics are once determined under some passenger compartment conditions, since the transmission characteristics vary greatly according to the other conditions deviating from the actually set speaker-microphone transmission characteristics, there exists a problem in that it is impossible to sufficiently bring the ability of the noise reduction system using the LMS algorithm to its full potential.

SUMMARY OF THE INVENTION

With these problems in mind, therefore, it is the primary object of the present invention to provide a passenger compartment noise reduction system, which can generate a primary source signal high in correlation to engine vibration noise and which is high in precision, reliability and stability, low in cost and easy to be mounted on the new vehicle body, without use of any additional vibration sensor.

Further, a second object of the present invention is to provide a noise reduction system, which can reduce noise within the passenger compartment, irrespective of the transient vehicle traveling conditions, without increasing the number of parts required for the system configuration.

Further, a third object of the present invention is to provide a noise reduction system, by which the speaker-microphone transmission characteristics can be determined finely according to various vehicle conditions, without requiring any complicated setting work and without generating unpleasant test noise to the driver or the passenger.

Further, a fourth object of the present invention is to provide a noise reduction system, by which a pleasant engine noise sound can be heard according to the preference of the driver or passenger so as to provide a comfortable drive feeling to the driver or passenger, without reducing all the noise frequency components.

To achieve the above-mentioned first object, the passenger compartment noise reduction system for automobiles according to the present invention comprises: detecting means for detecting engine operating conditions and outputting an engine operation signal; transforming means responsive to the detected engine operation signal, for transforming the engine operation signal into a vibration noise source signal with a frequency spectrum composed of predetermined order components of engine operation conditions and for outputting the transformed vibration noise source signal; synthesizing means responsive to the outputted vibration noise source signal, for synthesizing the transformed vibration noise source signal into a cancel signal on the basis of filter coefficients of an adaptive filter and outputting the synthesized cancel signal; sound generating means responsive to the synthesized cancel signal, for generating cancel sound to cancel vibration noise sound within a passenger compartment of an automobile; receiving means for receiving noise sound as an error signal at a noise receiving point; and updating means responsive to the received error signal and the transformed vibration noise source signal, for updating filter coefficients of the adaptive filter on the basis of both the detected engine operation signal and the received error signal.

The engine operating condition detecting means is means for detecting engine speed. The transforming means is means for generating vibration noise source signal having a frequency spectrum composed of 0.5×n (integers) order components of the number of engine revolutions. The synthesizing means is a finite impulse response adaptive filer having updatable filter coefficients. The sound generating means is at least one speaker. The receiving means is at least one microphone. The updating means is a least means square calculating circuit for calculating an instantaneous square of difference between the vibration noise source signal and the received error signal. The filter coefficients of the adaptive filter are updated on the basis of the calculated instantaneous square of the difference between the two so that the error signal level can be minimized.

To achieve the above-mentioned second object, the engine operation condition detecting means comprises means for detecting engine speed and means for detecting engine load. The transforming means is an input signal transforming circuit including a waveform shaping circuit for shaping waveforms of input signals as engine speed and engine load signals and a frequency component eliminating circuit for eliminating higher order frequency components from the engine speed signal, to obtain the vibration noise source signal with a frequency spectrum composed of 0.5×n order components of the number of engine revolutions and with an amplitude variable according to magnitude of the engine load, where n denotes integers.

To achieve the above-mentioned third object, said updating means further comprises passenger-influenced characteristic storing and setting means having: vacant condition setting means responsive to the engine operation signal outputted from said detecting means, for setting vacant condition transmission characteristics C'0mn between said sound generating means and said error signal receiving means; at least one seat sensing means for detecting presence or absence of a driver or a passenger and outputting a passenger presence signal; discriminating means responsive to the detected passenger presence signal, for discriminating passenger seat-take conditions; storing means for previously storing various passenger-influenced transmission characteristics CXmn according to various passenger seat taking conditions; manned condition setting means responsive to said storing means, for setting passenger-influenced transmission characteristics CXmn between said sound generating means and said error signal receiving means stored in said storing means in response to the discriminated passenger seat take conditions; and estimating means responsive to said unmanned condition setting means and said manned condition setting means, for estimating the current transmission characteristics CMN between said sound generating means and said error signal receiving means on the basis of both the unmanned condition transmission characteristics C'0mn and the set passenger-influenced transmission characteristics CXmn, the vibration noise source signal being convoluted by the estimated transmission characteristics CMN.

To achieve the above-mentioned fourth embodiment, said transforming means transforms the detected engine operation signal into a vibration noise source signal with a frequency spectrum composed of n-order components of the number of engine revolutions from which specific higher harmonics are selectively removed, where n denotes integers, so as not to cancel engine vibration noise sound generated by an engine of any given selected number S of engine cylinders.

The preferred embodiments of the present invention will become understood from the following detailed description referring to the accompanying drawings.

BRIEF DESCRIPTION OF THE DRAWINGS

FIG. 18 is an illustration for explaining the output signals of the signal transforming circuit of the fourth embodiment of the present invention; and FIG. (19)A, 19(A'), 19(B), 19(B'), 20(C) and 20(C') are illustrations for assistance in explaining the principle of the signal transforming circuit of the fourth embodiment of the present invention.

DETAILED DESCRIPTION OF THE PREFERRED EMBODIMENTS

The preferred embodiments of the passenger compartment noise reduction system of the present invention will be described hereinbelow with reference to the attached drawings.

Figure 1:
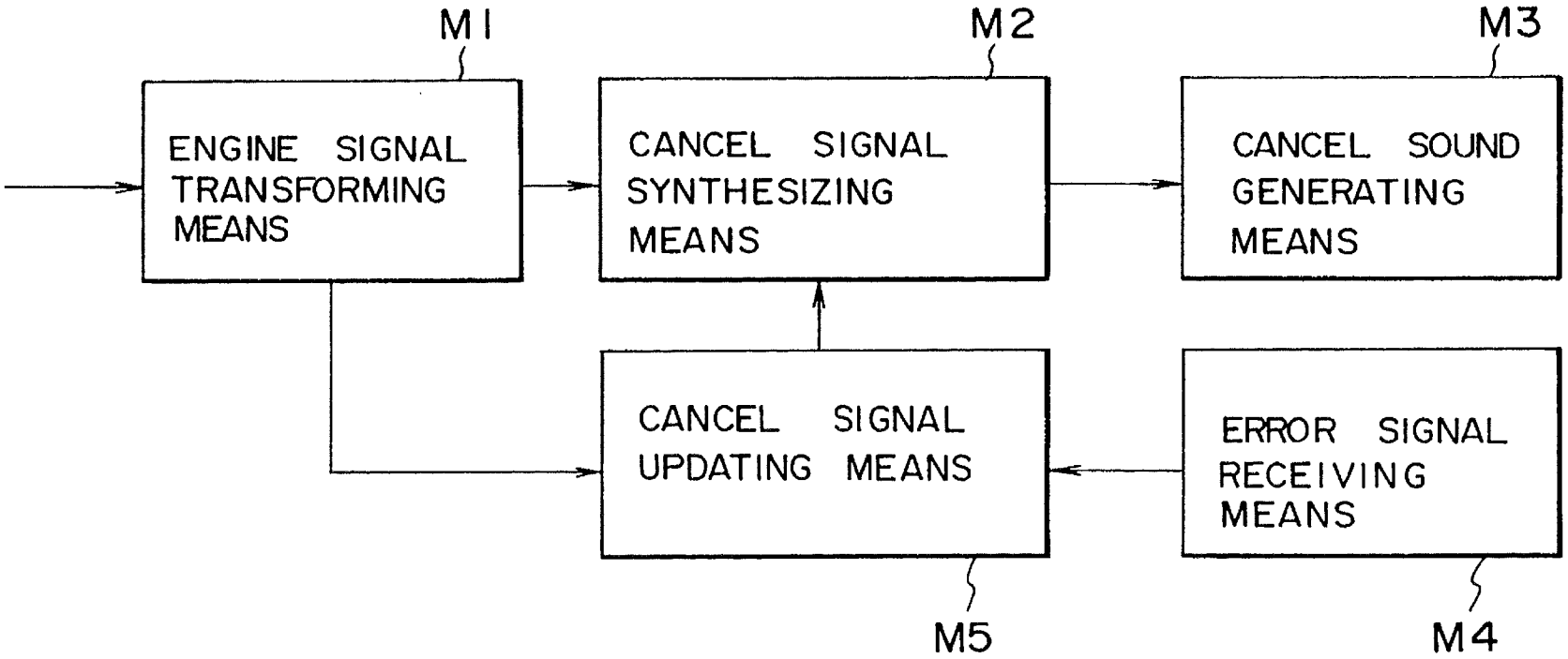
FIG. 1 is block diagram showing the concept of the noise reduction system of the present invention.

FIG. 1 is a conceptual block diagram for assistance in explaining the concept of the embodiments of the noise reduction system according to the present invention. In FIG. 1, an engine signal for an automotive vehicle is inputted to engine signal transforming means M1. The output of the transforming means M1 is applied to cancel signal synthesizing means M2. The output of the cancel signal synthesizing means M2 is given to cancel sound generating means M3 for generating canceling sound. Further, the noise sound within the passenger compartment is received by error signal receiving means M4. On the other hand, the output of the engine signal transforming means M1 and the output of error signal receiving means M4 are both transmitted to cancel signal updating means M5. Further, an update signal of the updating means M5 is given to the cancel signal synthesizing means M2 to update the cancel signal.

Figure 2:
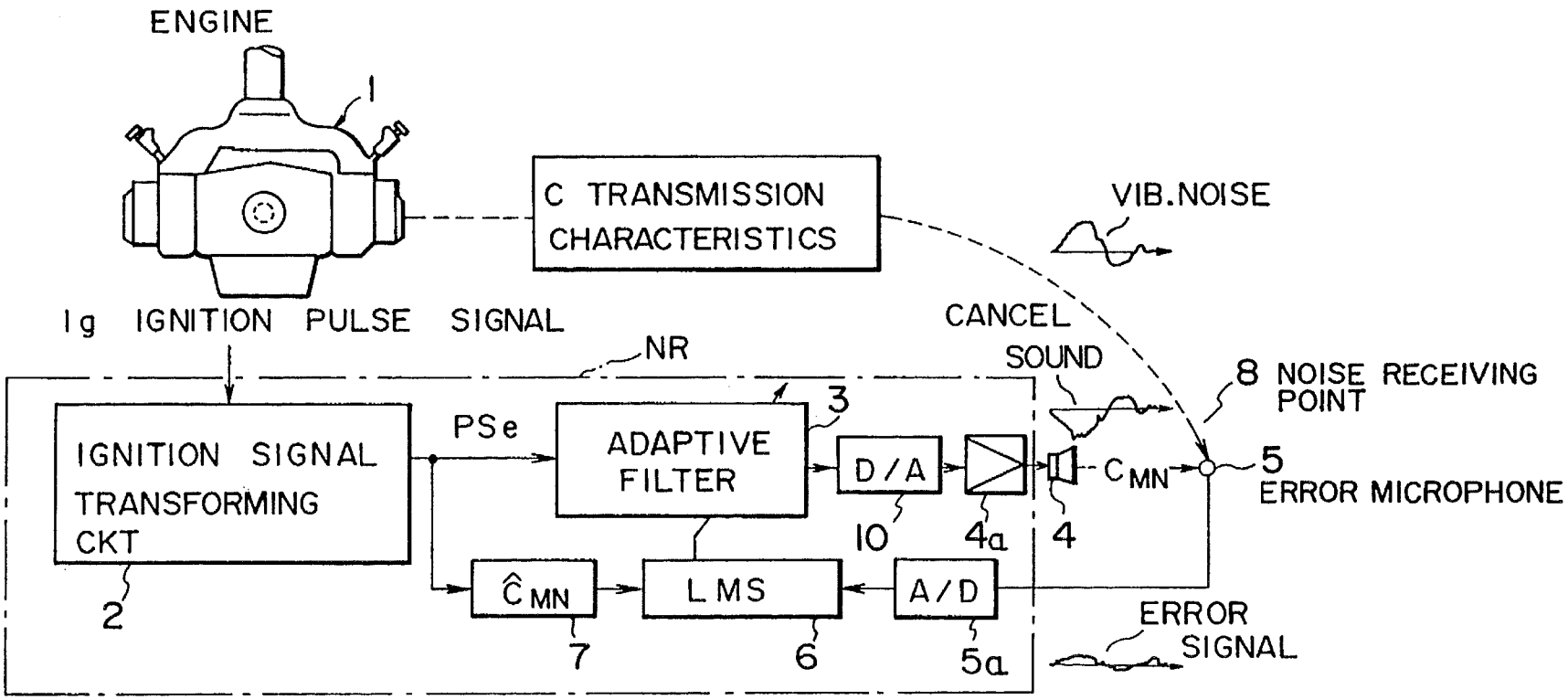
FIG. 2 is a schematic block diagram showing the system operation principle of a first embodiment of the passenger compartment noise reduction system according to the present invention.

FIG. 2 is a more practical block diagram showing a first embodiment of the present invention, in which there is shown a passenger compartment noise reduction system NR for reducing vibration noise generated by a 4-cylinder 4-cycle engine 1 and transmitted to a passenger compartment. The noise reduction system NR comprises an ignition signal transforming circuit 2 (i.e. the engine signal transforming means M1), an adoptive filter 3 (i.e. the cancel signal synthesizing means M2), an amplifier 4*a* and a speaker 4 (i.e. the cancel sound generating means M3), an error microphone 5 (i.e. the error signal receiving means M4), an LMS (least means square) calculating circuit 6 (i.e. the cancel signal updating means M5), a speaker-microphone transmission characteristic correcting circuit 7, various filter circuits (e.g. LP (lowpass) filter circuits), an A/D convertor 9, a D/A convertor 10, etc.

Figure 3:
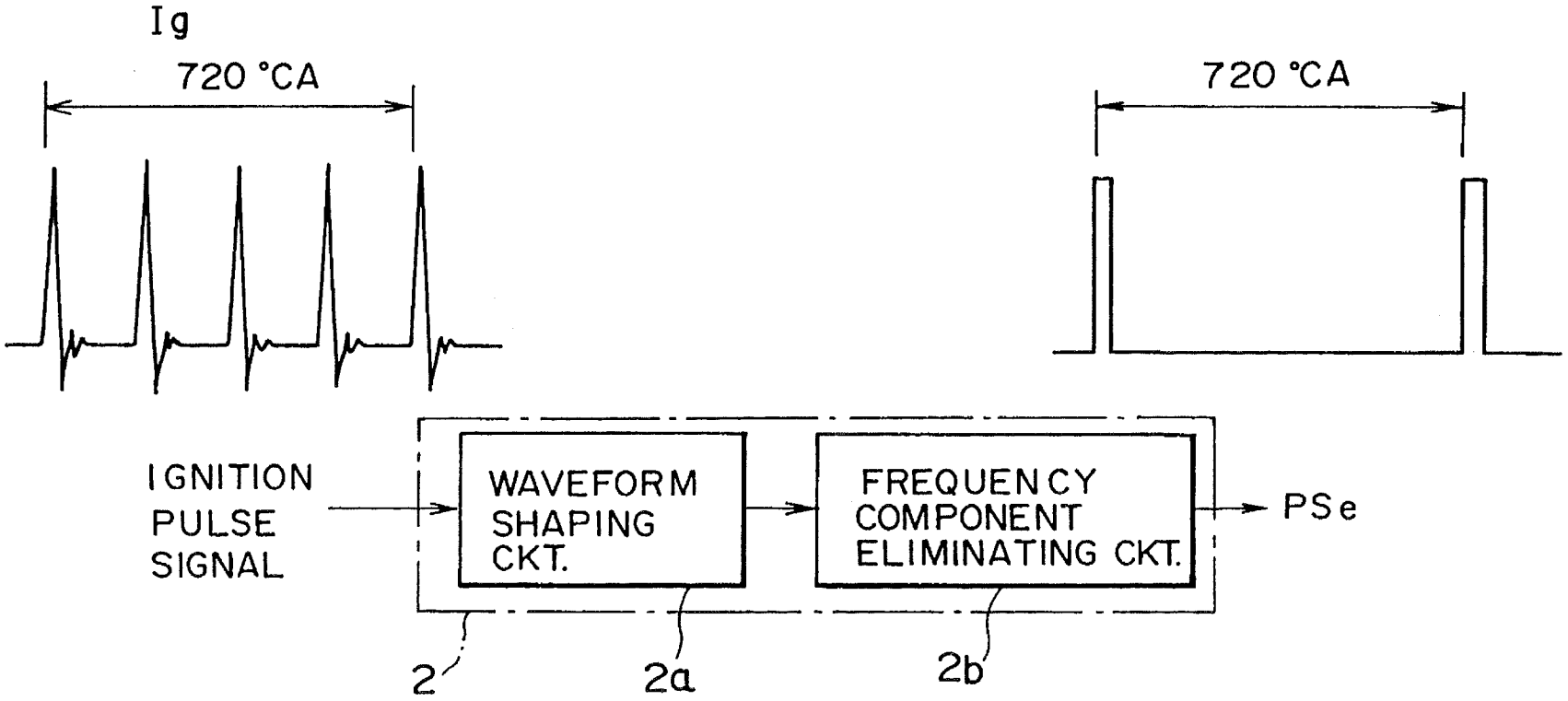
FIG. 3 is an illustration for explaining an ignition signal transforming circuit of the first embodiment of the present invention.

As shown in FIG. 3, the ignition signal transforming circuit 2 is composed of a waveform shaping circuit 2*a* and a frequency component eliminating circuit 2*b*. An ignition pulse signal Ig to be applied to an ignition coil (not shown) is inputted to the ignition signal transforming circuit 2. The ignition pulse signal Ig is a pulse signal generated one for each two engine revolutions in synchronism with the revolution of the engine 1. The ignition pulse signal Ig is processed (waveform-shaped and further frequency-component-eliminated) through the ignition signal transforming circuit 2. The processed ignition signal is then applied to the adaptive filter 3 and the speaker-microphone transmission characteristic correction circuit 7 as a vibration noise source signal (i.e. primary noise source signal) PSe.

Figure 4:
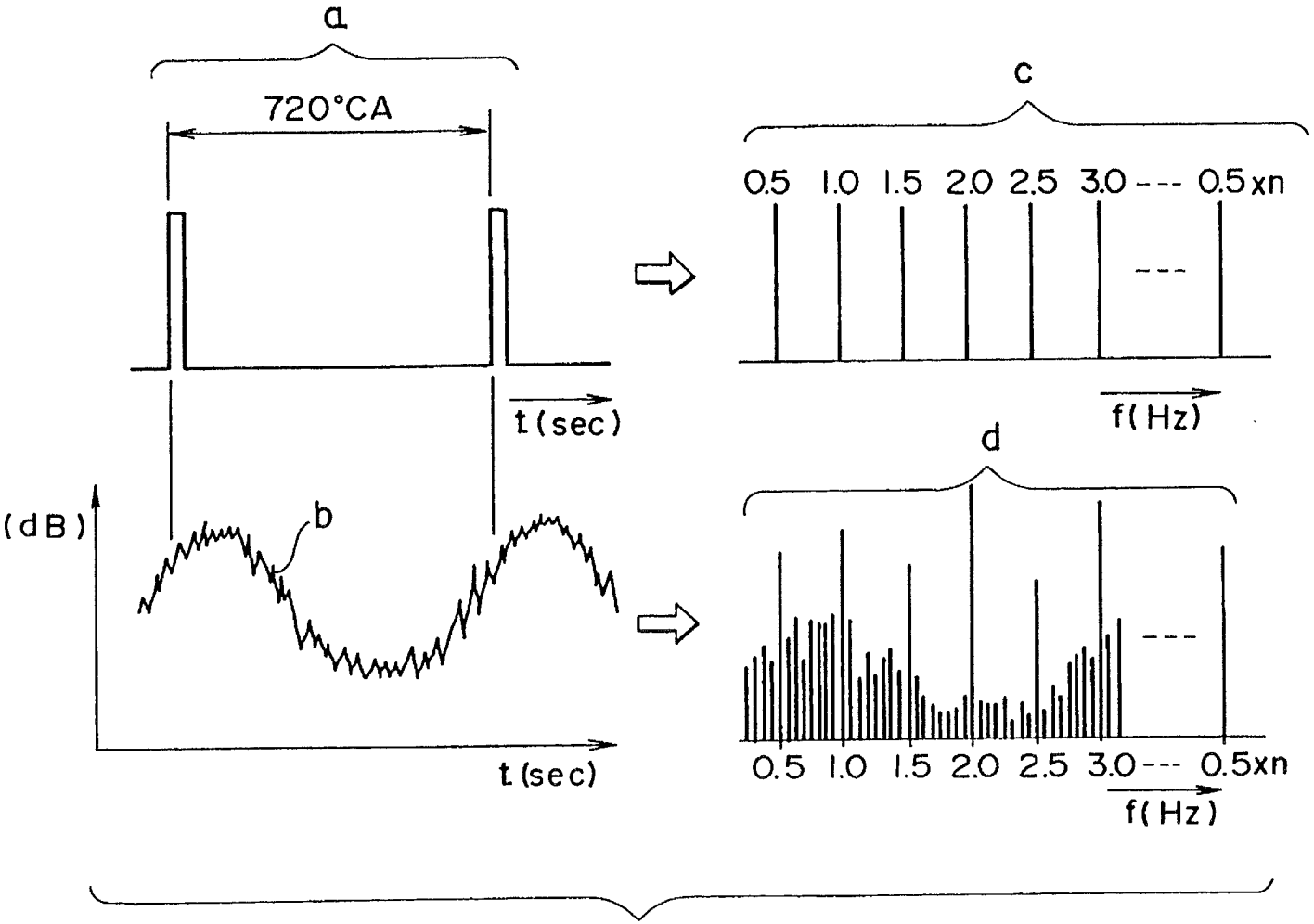
FIG. 4 is a correlation illustration showing the relationship between the vibration noise signal and the primary source signal of the first embodiment.

An exemplary waveform of the vibration noise source signal generated by a 4-cycle engine is shown by b in FIG. 4. The engine 1 completes four strokes of suction, compression, explosion and exhaustion during two engine revolutions (720 degrees CA (at crankshaft angle)). Therefore, one period of the above-mentioned noise source signal corresponds to two engine revolutions. As shown by d in FIG. 4, the vibration noise signal has a frequency spectrum mainly composed of a half (0.5) order component of the number of engine revolutions (one-cycle sine wave component for each two engine revolutions) as the fundamental harmonic (wave) and higher (1.0, 1.5, 2.0, 2.5, 3.0 etc.) order components of the number of engine revolutions as the higher harmonics (waves). In other words, the engine vibration noise sound is composed of 0.5×n (integers) order frequency components of the number of engine revolutions (r.p.s.). Accordingly, when the ignition pulse signal Ig is processed through the ignition signal transforming circuit 2 as described above, it is possible to obtain a primary source signal PSe as shown in FIG. 3, which is extremely high in correlation to the vibration noise sound required to be eliminated as shown by a and c in FIG. 4.

The adaptive filter 3 is a finite impulse response (FIR) filter having filter coefficients W(n) updatable by the LMS calculating circuit 6 (described later). In this embodiment, the adaptive filter 3 is provided with 256 taps. Without being limited thereto, however, it is possible to use another filter having taps more than 256 as far as a sufficient calculating speed and cost performance can be attained. In contrast with this, as far as a sufficient precision can be obtained, it is possible to use a filter having taps less than 256. The adaptive filter 3 calculates the sum of convolution products of the primary source signal applied from the ignition signal transforming circuit 2 and the filter coefficients. The adaptive filter 3 outputs the calculated sum of convolution products thereof as a cancel signal for canceling the vibration noise sound.

The cancel signal outputted from the adaptive filter 3 is given to an interior speaker 4 via the D/A convertor 10 and the amplifier 4*a*. The speaker 4 outputs canceling sound for canceling the vibration noise sound at a predetermined noise receiving point 8 (at which noise is reduced) within the passenger compartment, which corresponds to a head position of the driver seat, for instance. In the case of the example shown in FIG. 5, the above-mentioned speaker 4 is used in common with an audio-speaker mounted on the rear side in the compartment. Without being limited thereto, however, it is of course possible to arrange another noise reducing speaker.

An error microphone 5 is disposed near the above-mentioned noise receiving point 8. The error microphone 5 detects the interference results between the vibration noise sound and the canceling sound. The detected interference results are applied to the LMS calculating circuit 6 as an error signal. Further, the speaker-microphone transmission characteristics CMN are previously determined and set to the speaker-microphone transmission characteristic correcting circuit 7. Therefore, the primary source signal PSe supplied from the ignition signal transforming circuit 2 is corrected by multiplying the primary source signal PSe by the speaker-microphone transmission characteristics CMN. The corrected signal is inputted to the LMS calculating circuit 6. The LMS calculating circuit 6 calculates an instantaneous square of difference between the error signal received by the error microphone 5 and the above-mentioned corrected primary source signal. Further, the LMS calculating circuit 6 updates the filter coefficients W(n) of the adaptive filter 3 so that the error signal received by the error microphone 5 can be minimized.

Further, in FIG. 2, the symbol C denote the transmission characteristics on the basis of which engine vibration noise sound propagates from the engine 1 to the noise receiving point 8.

Figure 5:
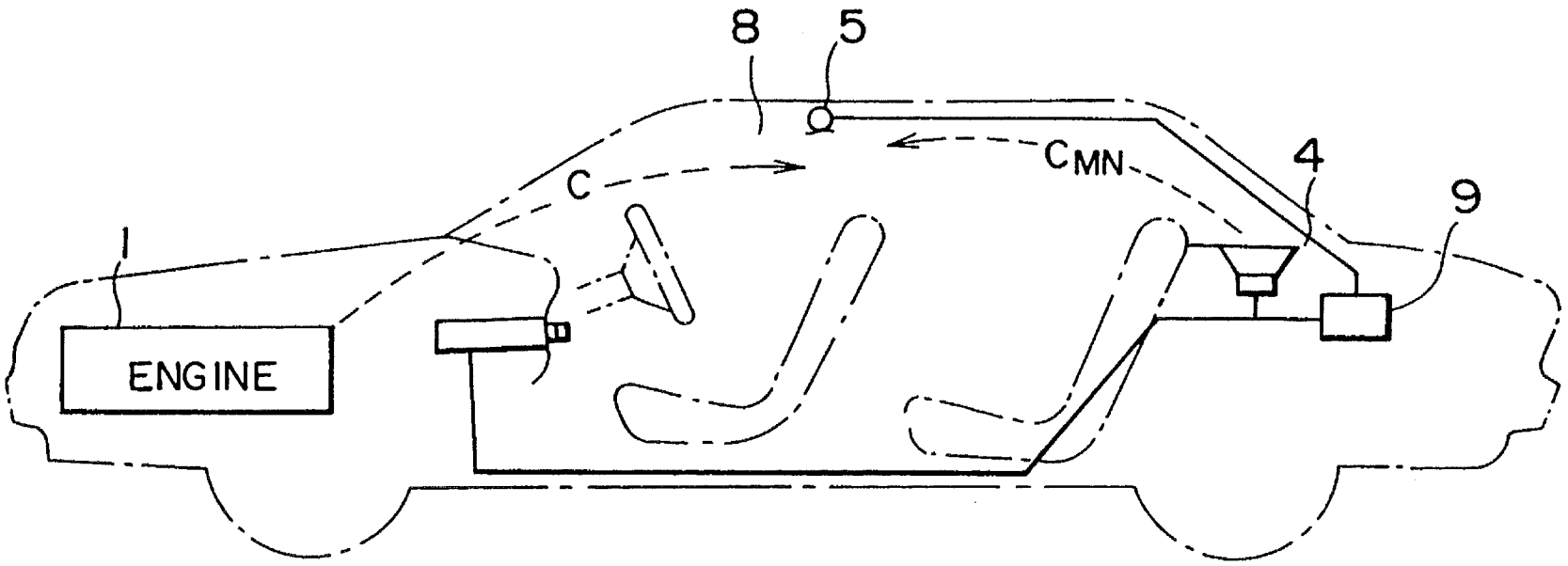
FIG. 5 is an illustration for explaining the composing element arrangement of the first embodiment of the noise reduction system according to the present invention.

Further, the above-mentioned ignition signal transforming circuit 2, the adaptive filter 3, the LMS calculating circuit 6, the speaker-microphone transmission correcting circuit 7, the A/D convertor 5*a*, the D/A convertor 10, etc. are all collected together and disposed as a passenger compartment noise reduction system control unit 9 at the rear portion of the vehicle body for instance, as shown in FIG. 5.

The operation of the noise reduction system thus constructed will be described hereinbelow.

Engine vibration noise sound is transmitted from an engine 1 into the passenger compartment via an engine mount (not shown) as internal noise sound within the passenger compartment. In addition, engine noise sound is also produced during engine suction and exhaust-strokes. The engine related vibration sound has a frequency spectrum mainly composed of 0.5×n (integers) order components of the number of engine revolutions as shown by b in FIG. 4. The noise sound multiplied by the vehicle body transmission characteristics C is transmitted to the noise receiving point 8.

On the other hand, the ignition pulse signal Ig to be applied to the ignition coil (not shown) of the engine 1 is a pulse signal generated one for each two engine revolutions in synchronism with the engine revolutions. The ignition signal Ig is waveform-shaped and frequency-component-eliminated to obtain a signal having frequencies of 0.5×n (integers) order components of the number of engine revolutions as the vibration noise source signal (the primary source signal) PSe. The obtained primary source signal PSe is outputted to the adaptive filter 3 and the speaker-microphone transmission correcting circuit 7.

The primary source signal PSe applied from the ignition signal transforming circuit 2 to the adaptive filter 3 is calculated to obtain the sum of convolution products of the primary source signal PSe and the filter coefficients W(n). The calculated sum of convolution products thereof are then transmitted to the interior speaker 4 via the D/A convertor 10 and the amplifier 4*a*, as the cancel signal for canceling the vibration noise sound. In other words, canceling sound for canceling the vibration noise sound at the noise receiving point 8 is outputted through the speaker 4. In this case, the canceling sound generated by the speaker 4 has been corrected by multiplying the primary source signal PSe by the speaker-microphone transmission characteristics CMN before being outputted from the speaker 4 to the noise receiving point 8.

Therefore, at the noise receiving point 8, the engine-related vibration noise sound and the canceling sound interfere with each other to reduce the vibration noise sound at the noise receiving point 8. Simultaneously, the interference results between the vibration noise sound and the canceling sound are detected by the error microphone 5 disposed near the noise receiving point 8 and further the detected results are applied to the LMS calculating circuit 6 as an error signal.

Further, the primary source signal outputted to the speaker-microphone transmission correction circuit 7 is multiplied by the previously determined speaker-microphone transmission characteristics CMN. The multiplied results are given to the LMS calculating circuit 6. The LMS calculating circuit 6 calculates an instantaneous square of difference between the error signal from the error microphone 5 and the primary source signal corrected by the correcting circuit 7, and further executes an algorithm for updating the filter coefficients W(n) of the adaptive filter 3 so that the error signal can be minimized.

As described above, since the ignition pulse signal widely used to control various functions of an automotive vehicle is adopted as the primary source signal, it is possible to realize the passenger compartment noise reduction system high in reliability and low in cost, without need of any additional engine vibration sensors.

Further, since the engine-related vibration noise sound includes various noise, for instance such as air suction noise, exhaust noise, etc. in addition to the engine vibration noise, it is possible to realize a more effective noise reduction system, as compared-with the case where the engine vibrations are partially detected by use of any vibration sensors to obtain the primary source signal.

Further, since a primary source signal extremely high in correlation to the engine related vibration noise sound can be obtained without use of any additional sensors such as a vibration sensor, it is possible to easily mount the noise reduction system of the present invention newly on an automotive vehicle provided with no noise reduction system.

In the above-mentioned embodiment, the noise reduction system provided with only a single LMS algorithm for one-channel (one error microphone and one speaker) has been described by way of example. Without being limited thereto, however, it is of course possible to apply the above-mentioned principle to the noise reduction system provided with a MEFX (multiple error filtered X) LMS algorithm for multiple channels (e.g. four error microphones and four speakers) by expanding the above-mentioned single LMS algorithm. In this case, it is possible to obtain the primary source signal extremely high in correlation to the engine related vibration noise sound by waveform shaping and further processing the engine ignition signal.

A second embodiment of the present invention will be described hereinbelow with reference to FIGS. 6 and 7. The feature of this second embodiment is to vary the amplitude of the primary source signal PSe according to magnitude of detected engine load, so that the noise reduction performance can be further improved even during the transient engine operation.

Figure 6:
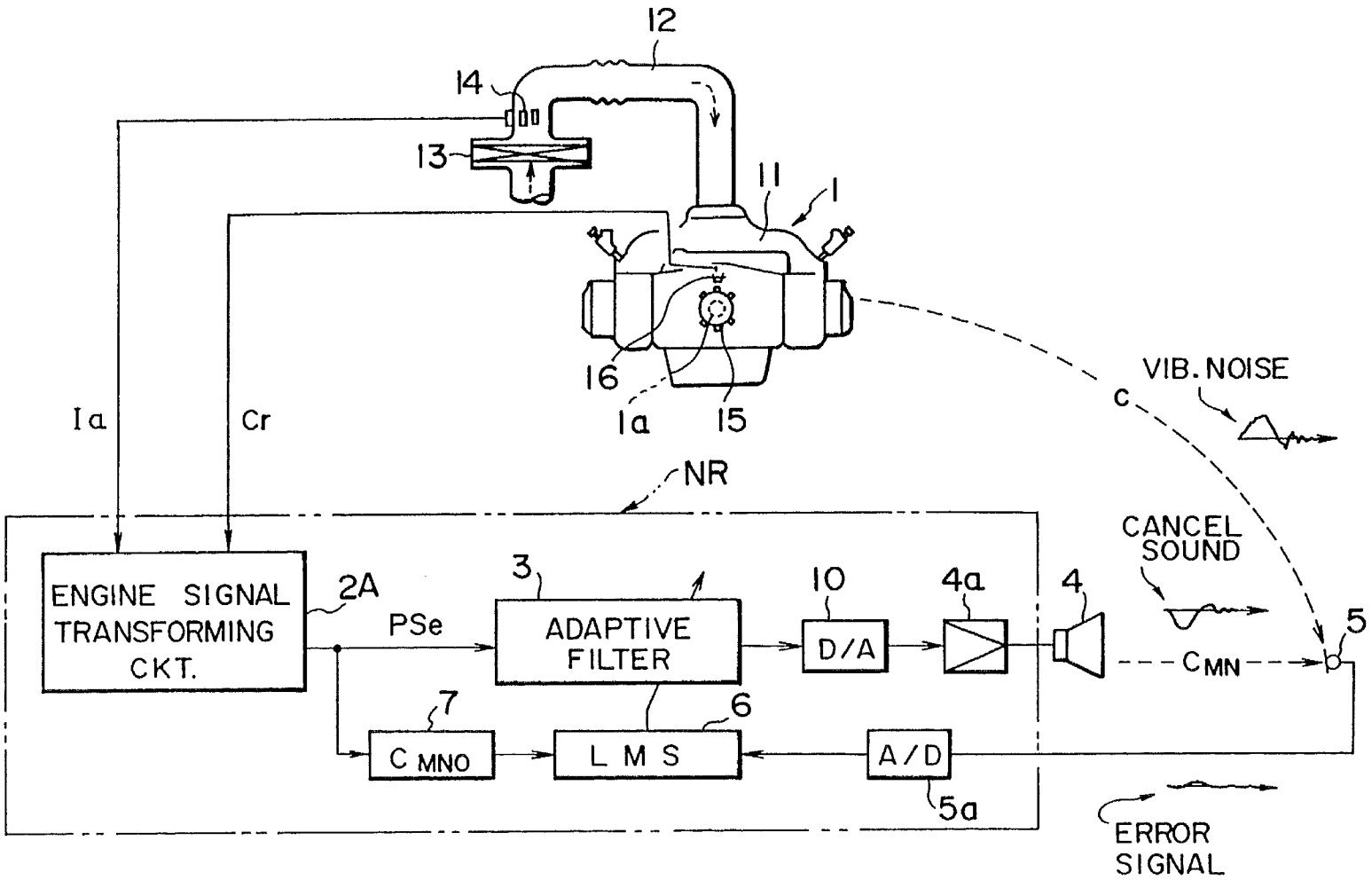
FIG. 6 is a schematic block diagram showing the system operation principle of a second embodiment of the noise reduction system according to the present invention.

In FIG. 6, an air cleaner 13 is disposed on the upstream side of an intake manifold 11 of an engine 1 via an intake pipe 12. Further, an intake air amount sensor 14 is provided as engine load detecting means on the downstream side of and near the air cleaner 13. Further, a crank angle detecting rotor 15 is attached to a crankshaft 1*a* of the engine 1. A crank angle sensor 16 of an electromagnetic pickup type for instance, for detecting projections formed on the rotor 15 (i.e. a body to be detected) is disposed near the outer circumferential surface of the crank angle detecting rotor 15.

In the noise reduction system NR of this embodiment, an intake air amount signal Ia of the intake air amount sensor 14 and a crank angle signal Cr of the crank angle sensor 16 are both inputted to an input signal transforming-circuit 2A of the noise reduction system NR.

Figure 7:
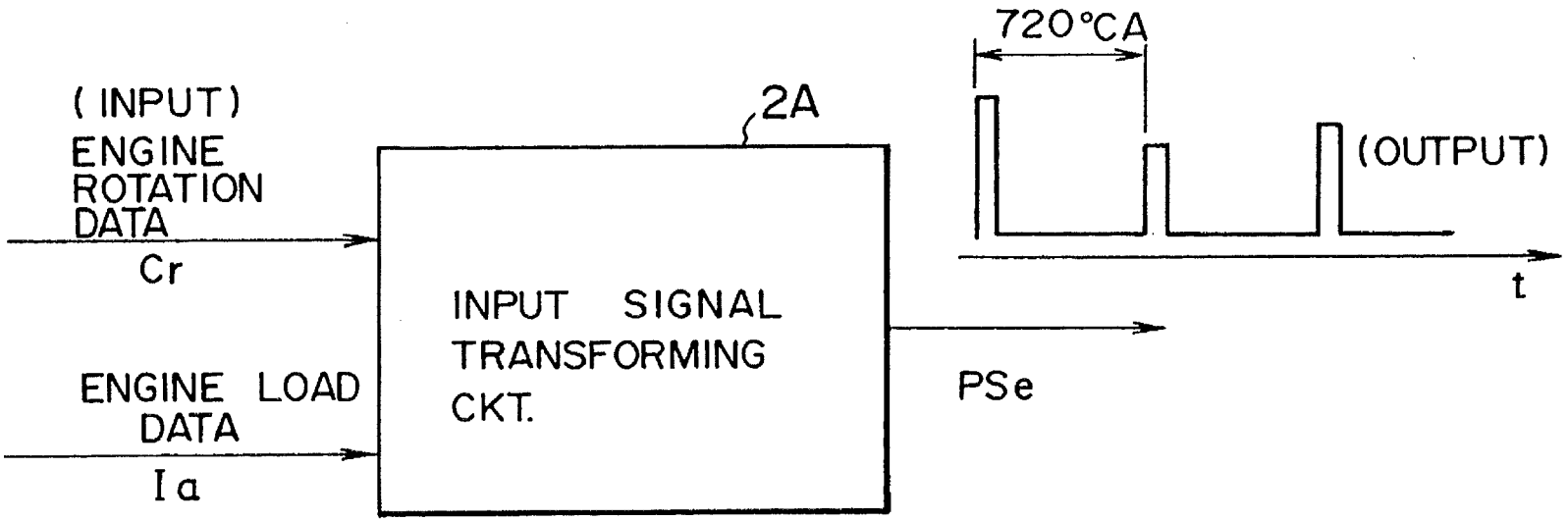
FIG. 7 is an illustration for explaining an input signal transforming circuit of the second embodiment of the present invention.

As shown in FIG. 7, the input signal transforming circuit 2A waveform-shapes and processes both the intake air amount signal Ia supplied from the intake air amount sensor 14 and the crank angle signal Cr supplied from the crank angle sensor 16, in order to output a vibration noise source signal (the primary source signal) in synchronism with the number of engine revolutions. The frequency range of the primary source signal is represented by a frequency spectrum composed of 0.5×n (integers) order components of the number of engine revolutions, and additionally the amplitude of the primary source signal varies according to the engine load. The processed primary source signal PSe is outputted to the adaptive filter 3 (i.e. the cancel signal synthesizing means) and the speaker-microphone transmission characteristic estimating circuit (CMNO) 7. The construction of the systems other than the above is substantially the same as with the case of the first embodiment shown in FIG. 2.

In the second embodiment, the sampling frequency of the error signal received by the error microphone 5 is 3 kHz. Therefore, the filter coefficients W(n) of the adaptive filter 10 are updated at a frequency of 3 kHz (3000 times per sec). However, the sampling frequency is not limited to only the above-mentioned 3 kHz.

In a second embodiment, the primary source signal extremely high in correlation to the vibration noise sound required to be eliminated can be obtained by use of the engine load detecting means and the engine speed detecting means both already provided for with ordinary automotive vehicles. Therefore, it is possible to realize a noise reduction system high in reliability and low in cost, without need of any additional vibration sensors.

Further, since the primary source signal includes with factor of the engine load, the response characteristics of the noise reduction can be further improved even during the transient operation of the engine.

Further, since the engine-related vibration noise sound includes the other factors of suction, exhaust, etc., it is possible to more effectively achieve noise reduction, as compared with when the primary source signal is obtained only by detecting partial engine vibrations by use of a vibration sensor.

Further, since a primary source signal extremely high in correlation to the engine-related vibration noise sound can be obtained without use of any other vibration sensors, it is possible to easily and newly mount the noise reduction system within the passenger compartment.

Further, in this embodiment, although the engine load information is obtained by the intake air amount sensor, it is of course possible to obtain the engine load information by use of various engine load detecting means (e.g. throttle opening sensor, engine intake pipe load sensor, etc.) other than the intake air amount sensor.

Further, in this embodiment, although the engine speed information is obtained by the crank angle sensor, it is of course possible to obtain the engine speed information by use of various engine speed detecting means (e.g. cam angle sensor, fuel injection pulse, ignition pulse signal, etc.) other than the crank angle sensor.

A third embodiment of the present invention will be described hereinbelow with reference to FIG. 8. The feature of this third embodiment is to finely determine the speaker-microphone transmission characteristics under consideration of both vacant and occupied conditions, without need of any complicated setting work and without generating unpleasant test noise to the passengers.

Figure 8:
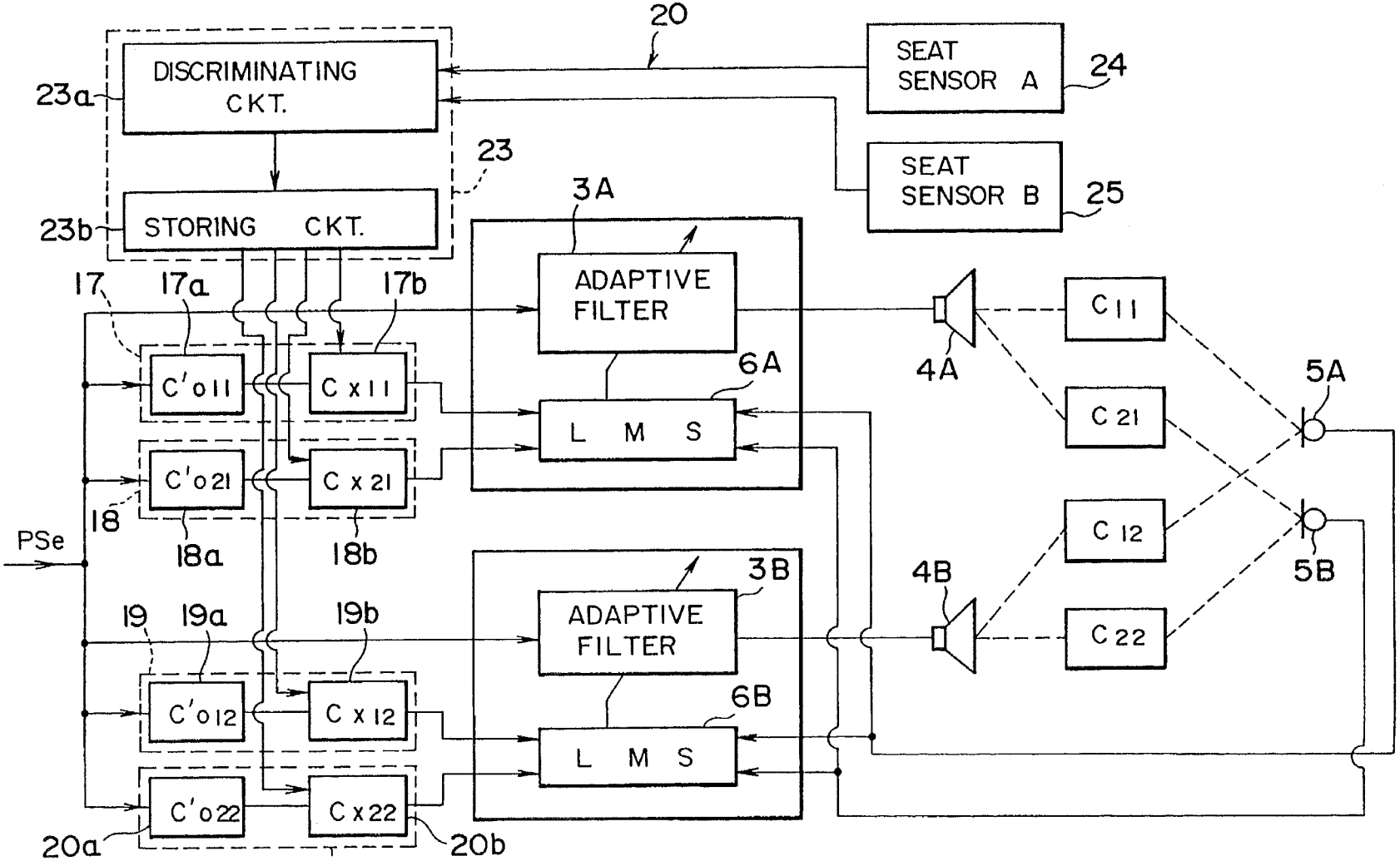
FIG. 8 is a schematic block diagram showing the system operation principle of a third embodiment of the noise reduction system according to the present invention.

A passenger compartment noise reduction system 20 shown in FIG. 8 comprises two adaptive filters 3A and 3B (i.e. the cancel signal synthesizing means M2), to which a vibration noise source signal (primary source signal) PSe high in correlation to the engine-related vibration noise sound generated by the engine (not shown) is inputted. These adaptive filters 3A and 3B are connected to two speakers 4A and 4B (i.e. the cancel sound generating means M3)) via two D/A convertors (both not shown), respectively. Further, two error microphones 5A and 5B for detecting noise reduction states and generating error signals (i.e. the error signal receiving means M4) are disposed at two noise receiving points, respectively. Further, four speaker-microphone transmission characteristic estimating circuits 17, 18, 19 and 20 for receiving the primary source signal SPe, and two LMS calculating circuits 6A and 6B (i.e. the cancel signal updating means M5) are also incorporated. To the LMS circuit 6A, signals from the speaker-microphone transmission characteristic estimating circuits 17 and 18 and the error signals from the error microphones 5A and 5B are inputted. On the basis of these inputted signals, the LMS calculating circuit 6A updates the filter coefficients of the adaptive filter 3A (i.e. the cancel signal synthesizing means M2). Similarly, to the LMS circuit 6B, signals from the speaker-microphone transmission characteristic estimating circuits 19 and 20 and the error signals from the error microphones 5A and 5B are inputted. On the basis of these inputted signals, the LMS calculating circuit 6B updates the filter coefficients of the adaptive filter 3B (i.e. the cancel signal synthesizing means M2)).

The primary source signal PSe is a signal obtained by processing the signals such as ignition pulse, fuel injection pulse, crank angle sensor signal, etc. so as to represent the engine speed and engine load, which is high in correlation to the engine vibration noise sound.

Figure 9:
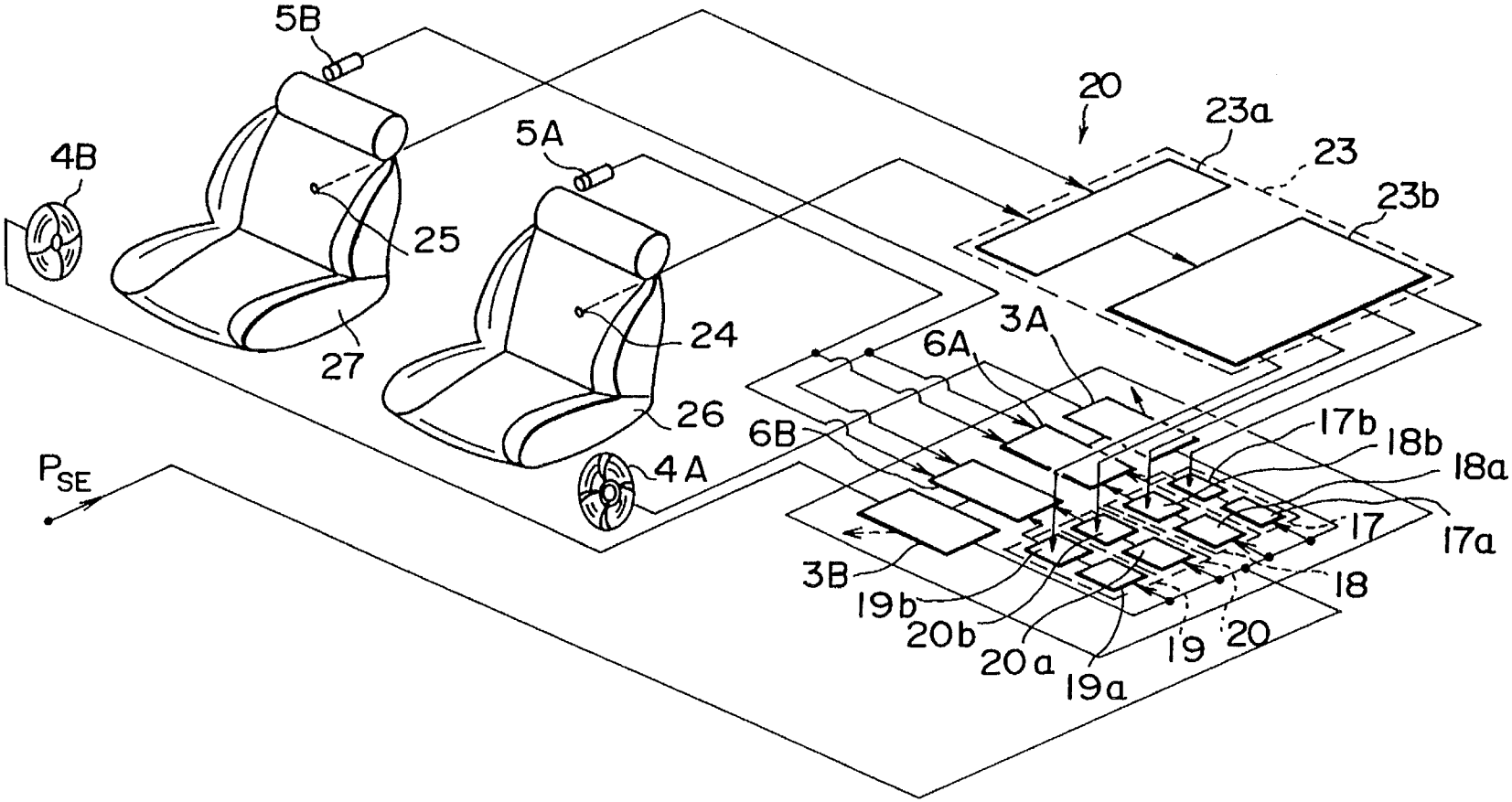
FIG. 9 is a perspective view showing the composing element arrangement of the third embodiment of the noise reduction system according to the present invention shown in FIG. 8.

The speakers 4A and 4B are disposed in vehicle front doors (not shown), and the error microphones 5A and 5B are disposed at the noise receiving points (e.g. positions near the ears of the front passengers taking front seats 26 and 27, as shown in FIG. 9). These microphones 5A and 5B detect the interference results between vibration noise sound and canceling sound, and the detected results are applied to the LMS calculating circuits 6A and 6B as the error signals, respectively.

Further, the LMS calculating circuit 6A calculates two instantaneous squares of differences (filter correcting rate) between the error signals from the error microphones 5A and 5B and the signals from the speaker-microphone transmission characteristic estimating circuits 17 and 18 respectively, and further updates the filter coefficients of the adaptive filter 3A so that the error signals detected by the error microphones 5A and 5B can be minimized. Similarly, the LMS calculating circuit 6B calculates two instantaneous squares of differences (filter correcting rate) between the error signals from the error microphones 5A and 5B and the signals from the speaker-microphone transmission characteristic estimating circuits 19 and 20 respectively, and further updates the filter coefficients of the adaptive filter 3B so that the error signals detected by the error microphones 5A and 5B can be minimized.

Each of the speaker-microphone transmission characteristic estimating circuits 17, 18, 19 and 20 is composed of an vacant condition transmission characteristic setting circuit (C'0mn) 17*a*, 18*a*, 19*a* and 20*a* and passenger-influenced characteristic setting circuits (C Xmn) 17*b*, 18*b*, 19*b* and 20*b* (i.e. occupied condition transmission characteristic setting means). A passenger-influenced characteristic setting circuit 23 is connected to these CXmn circuits 17*b*, 18*b*, 19*b* and 20*b*. Further, m of the C'0mn circuits and the CXmn circuits denotes the number of microphones 5A and 5B (the error microphone 5A is No. 1 and the error microphone 5B is No. 2) and n of the C'0mn circuits and the CXmn circuits denotes the number of speakers 4A and 4B (the speaker 4A is No. 1 and the speaker 4B is No. 2). In other words, the speaker-microphone transmission characteristics between the speaker 4A and the error microphone 5A are represented by C11; the speaker-microphone transmission characteristics between the speaker 4A and the error microphone 5B are represented by C21; the speaker-microphone transmission characteristics between the speaker 4B and the error microphone 5A are represented by C12; and the speaker-microphone transmission characteristics between the speaker 4B and the error microphone 5B are represented by C22. Further, the above-mentioned respective C'0mn circuits are represented by a C'011 circuit 17*a*, a C'021 circuit 18*a*, a C'012 circuit 19*a* and a C'022 circuit 20*a*, respectively. Further, the respective CXmn are represented by a CX11 circuit 17*b*, a CX21 circuit 18*b*, a CX12 circuit 19*b* and a CX22 circuit 20*b*, respectively.

Further, the passenger-influenced characteristic setting circuit 23 is composed of a passenger take-seat discriminating circuit 23*a* and a passenger-influenced characteristic storing circuit (CX storing circuit) 23*b*. The passenger take-seat discriminating circuit 23*a* is connected to two seat sensors 24 and 25 for detecting the presence or absence of passengers. The passenger-influenced characteristic storing and setting circuit (CX storing and setting circuit) 23 stores previously determined passenger-influenced characteristics CXmn obtained under due consideration of various passenger take-seat conditions in combination, and further sets the stored passenger-influenced characteristics CXmn to the CXmn circuits 17*b*, 18*b*, 19*b* and 20*b*, in response to the passenger presence signals from the passenger take-seat discriminating circuit 23*a*. The passenger-influenced characteristic storing and setting circuit 23, the C'0mn circuits 17*a*, 18*a*, 19*a* and 20*a* and the CXmn circuits 17*b*, 18*b*, 19*b* and 20*b* construct passenger-influenced characteristic storing and setting means in combination.

The seat sensor 24 is disposed at a front left passenger seat 26, and the seat sensor 25 is disposed at a front right passenger seat 27. Each of these seat sensors can detect the presence or absence of a passenger by turning on or off a switch, for instance in response to the passenger weight beyond a predetermined value. Further, it is of course possible to use an optical sensor such as infrared sensor, a weight sensor such as load cell, etc. as the seat sensors 24 and 25. When the weight sensor such as load cell for detecting the weight is used, it is also possible to detect whether the passenger is an adult or a child, that is, it is possible to accurately detect the seat taking conditions of the passenger. Further, it is possible to use both the optical sensor such as the infrared sensor and the weight sensor such as the load sensor in combination to more accurately detect the passenger seat taking conditions. Further, when the ignition switch is turned on, it is possible to detect that the driver takes the front seat. In this case, it is unnecessary to provide the seat sensor disposed at the front driver seat.

The method of setting the characteristics of the respective C'0mn circuits 17*a*, 18*a*, 19*a* and 20*a* and the respective CXmn circuits 17*b*, 18*b*, 19*b* and 20*b* will be described hereinbelow with reference to diagrams shown in FIGS. 10 to 12.

Figure 10:
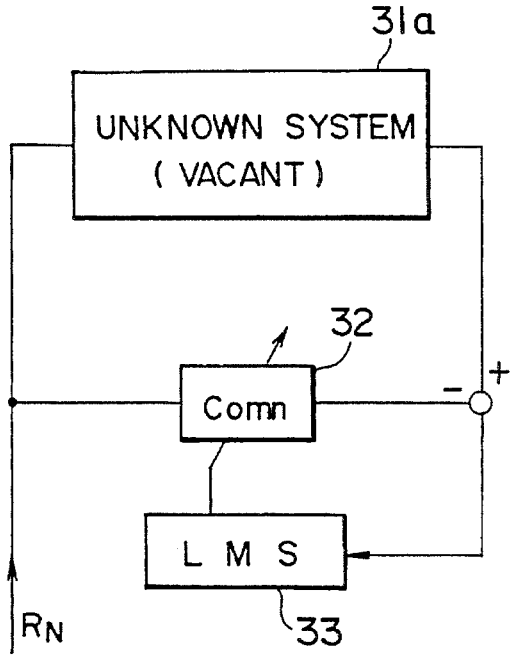
FIG. 10 is a conceptual diagram showing the initial setting (before shipment) of the vacant condition speaker-microphone transmission characteristics of the third embodiment of the present invention shown in FIG. 8.

As shown in FIG. 10, the system between the error microphones 5A and 5B and the speaker 4A in the initial vacant conditions (e.g. before shipment) is set as an unknown system 31*a* having actual transmission characteristics C0mnl. Random noise sound RN including predetermined frequency components is inputted to the unknown system 31*a* and the transmission characteristic setting circuit (C0mn setting circuit) 32 having updatable transmission characteristics C0mn (C011, C021). The random noise sound RN inputted to the unknown system 31*a* is outputted from the speaker 4A, and then received by the error microphones 5A and 5B after being subjected to the influence of the actual speaker-microphone transmission characteristics (C0111, C0211). The signals detected by the error microphones 5A and 5B and the signal outputted from the C0mn setting circuit 32 are superposed upon each other, and then outputted to the LMS circuit 33 as an error signal. The LMS circuit 33 updates the transmission characteristics C0mn of the C0mn setting circuit 32, so as to minimize the error signal. The updated value is set as the initial vacant condition speaker-microphone transmission characteristics C011 and C021, respectively. In the same way, the system between the error microphones 5A and 5B and the speaker 4B is identified as the unknown system, and the initial unmanned condition speaker-microphone transmission characteristics C012 and C022 are set.

Figure 11:
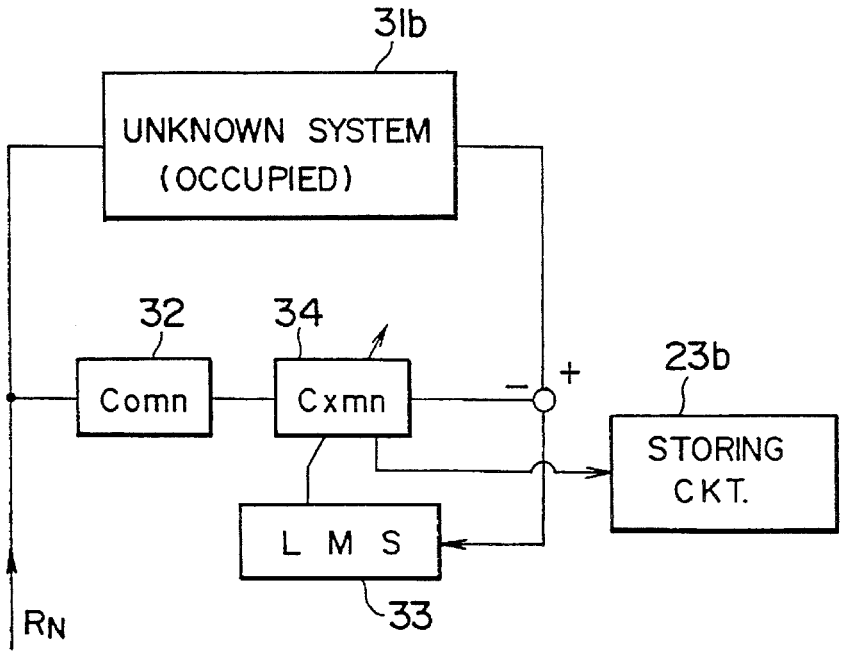
FIG. 11 is a conceptual diagram showing the initial (before shipment) setting of the passenger-influenced characteristics of the third embodiment of the present invention shown in FIG. 8.

Subsequently, as shown in FIG. 11, the system between the error microphones 5A and 5B and the speaker 4A in the initial occupied conditions (e.g. before shipment) is set as an unknown system 31*b* having actual transmission characteristics C0mn2. Random noise sound RN including predetermined frequency components is inputted to the unknown system 31*b* and the passenger-influenced characteristic setting circuit (CXmn setting circuit) 34 having updatable passenger-influenced characteristics CXmn (CX11, CX21) connected in series with the C0mn setting circuit 32. The random noise sound RN inputted to the unknown system 31*b* is outputted from the speaker 4A, and then received by the error microphones 5A and 5B after being subjected to the influence of the actual speaker-microphone transmission characteristics (C0112, C0212). The signals detected by the error microphones 5A and 5B and the signal outputted from the CXmn setting circuit 34 are superposed upon each other, and then outputted to the LMS circuit 33 as an error signal. The LMS circuit 33 updates the transmission characteristics CXmn of the CXmn setting circuit 34, so as to minimize the error signal. The updated value is set as the initial occupied condition speaker-microphone transmission (passenger-influenced) characteristics CX11 and CX21. In the same way, the system between the error microphones 5A and 5B and the speaker 4B is identified as the unknown system, and the initial occupied condition speaker-microphone transmission (passenger-influenced) characteristics CX12 and CX22 are set. In addition, when a front passenger other than the driver takes seat, the system is identified in the same way. That is, the passenger-influenced characteristics CXmn is measured; and the passenger-influenced characteristics CXmn thus obtained are stored in the CX storing circuit 23*b*. Further, the number of combinations of the passenger' seat-taking conditions can be determined by the number of combinations of signals detected by the seat sensors.

Figure 15:
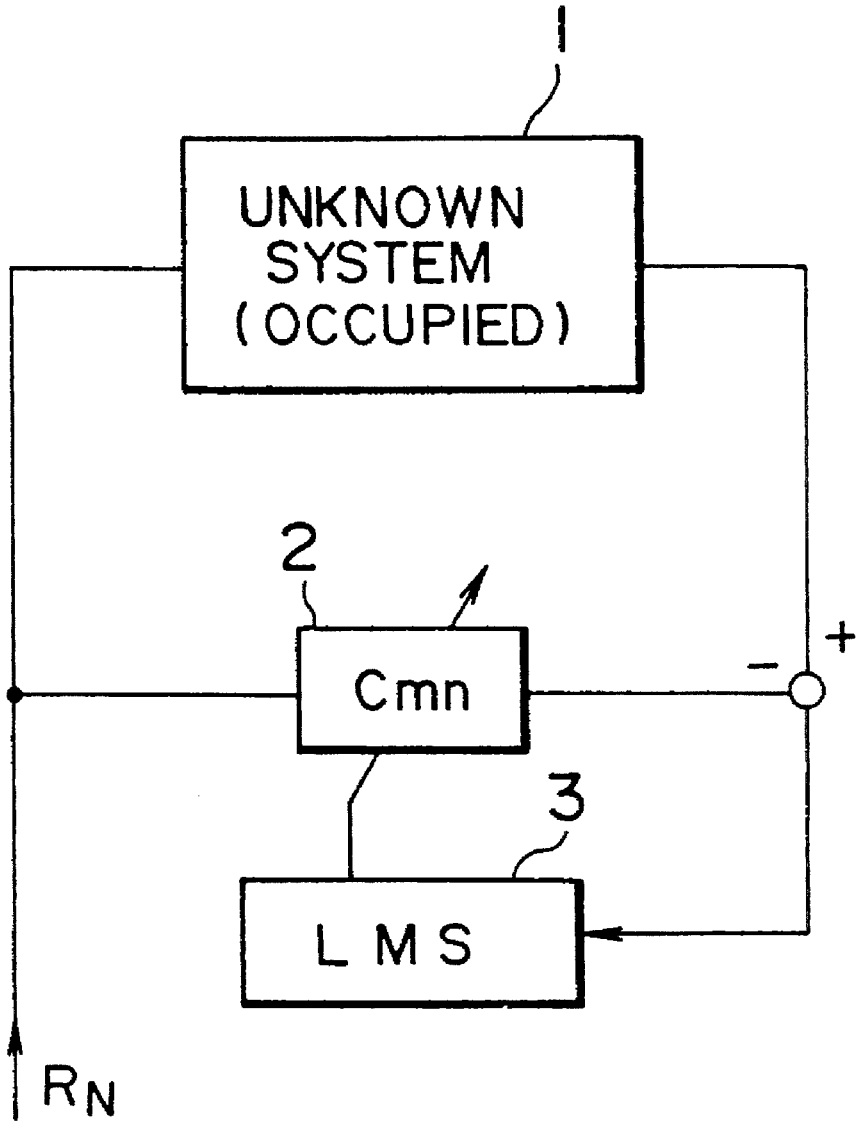
FIG. 15 is a conceptual diagram showing the setting of the speaker-microphone transmission characteristics of the first embodiment for comparison.

Further, FIG. 15 is a diagram showing the setting of the speaker-microphone transmission characteristics CMN in the first embodiment of the noise reduction system shown in FIG. 2, for comparison with the third embodiment.

In the above-mentioned third embodiment, the passenger-influenced characteristics have been taken into account only with respect to two types (the presence of a driver, and the presence of a driver and another front passenger taking the front seat). However, when two additional error microphones are disposed at the rear seats to reduce noise sound for the rear passengers taking rear seats, the following eight passenger-influenced characteristics are to be obtained and stored: [only a driver], [a driver and a front passenger], [a driver and a rear passenger on the driver side], [a driver and a rear passenger on the front passenger side], [a driver, a front passenger, a rear passenger on the driver side], [a driver, a front passenger, a rear passenger on the front passenger side], [a driver, a rear passenger on the driver side, and a rear passenger on the front passenger side], and [a driver, a front passenger, a rear passenger on the driver side, and a rear passenger on the front passenger side].

Figure 12:
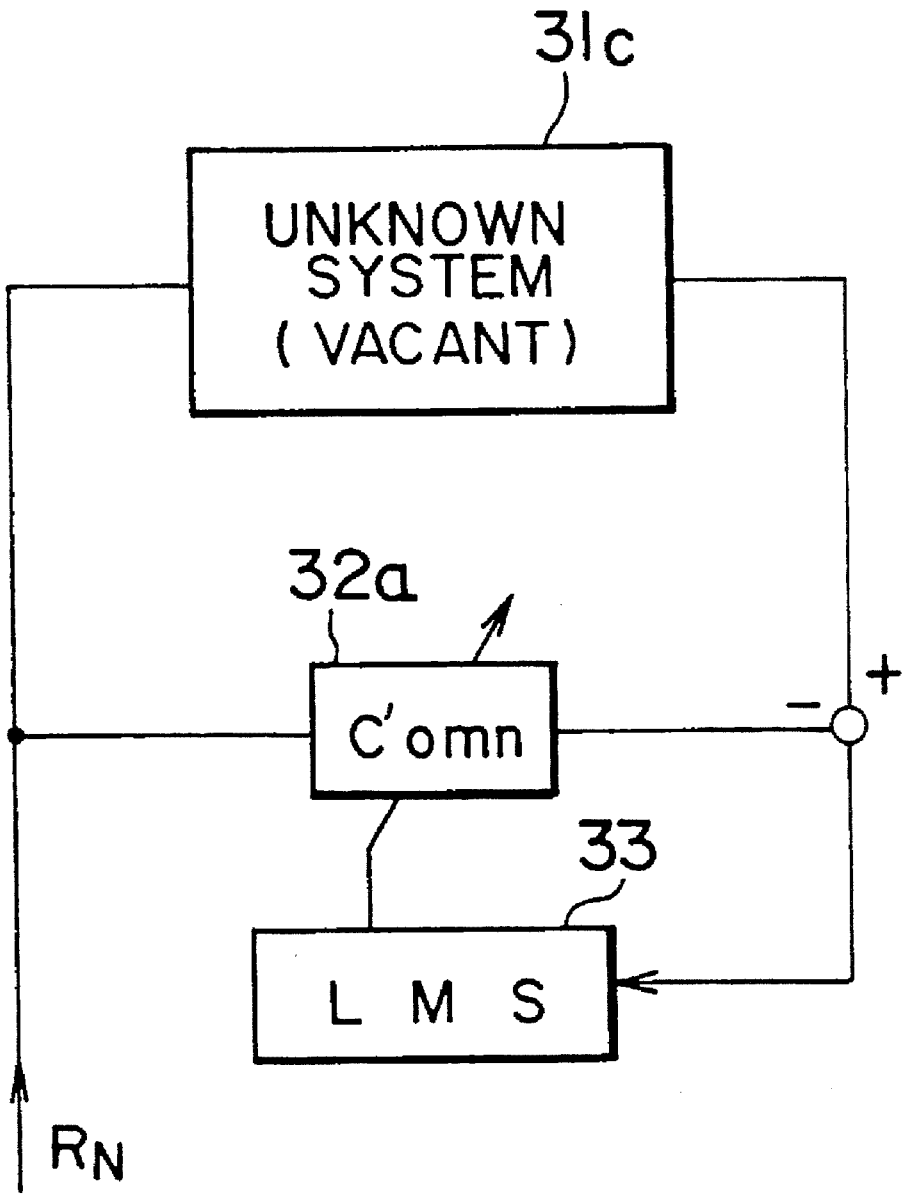
FIG. 12 is a conceptual diagram showing the before-use (after shipment) setting of the vacant condition speaker-microphone transmission characteristics of the third embodiment of the present invention shown in Fig. 8.

The passenger-influenced characteristics after shipment or delivery have been set as shown in FIG. 12. When the vacant condition is detected before a passenger or passengers get on the automotive vehicle or after a passenger or passengers get off the automotive vehicle, the system between the error microphones 5A and 5B and the speaker 4A under vacant conditions is set as an unknown system 31*c*, and the before-use (after delivery) vacant condition speaker-microphone transmission characteristics C'0mn (C'011, C'021, C'012 and C'022) are set as occasion demands, in the same way as with the case where the initial vacant condition speaker-microphone transmission characteristics C0mn are set.

Figure 13:
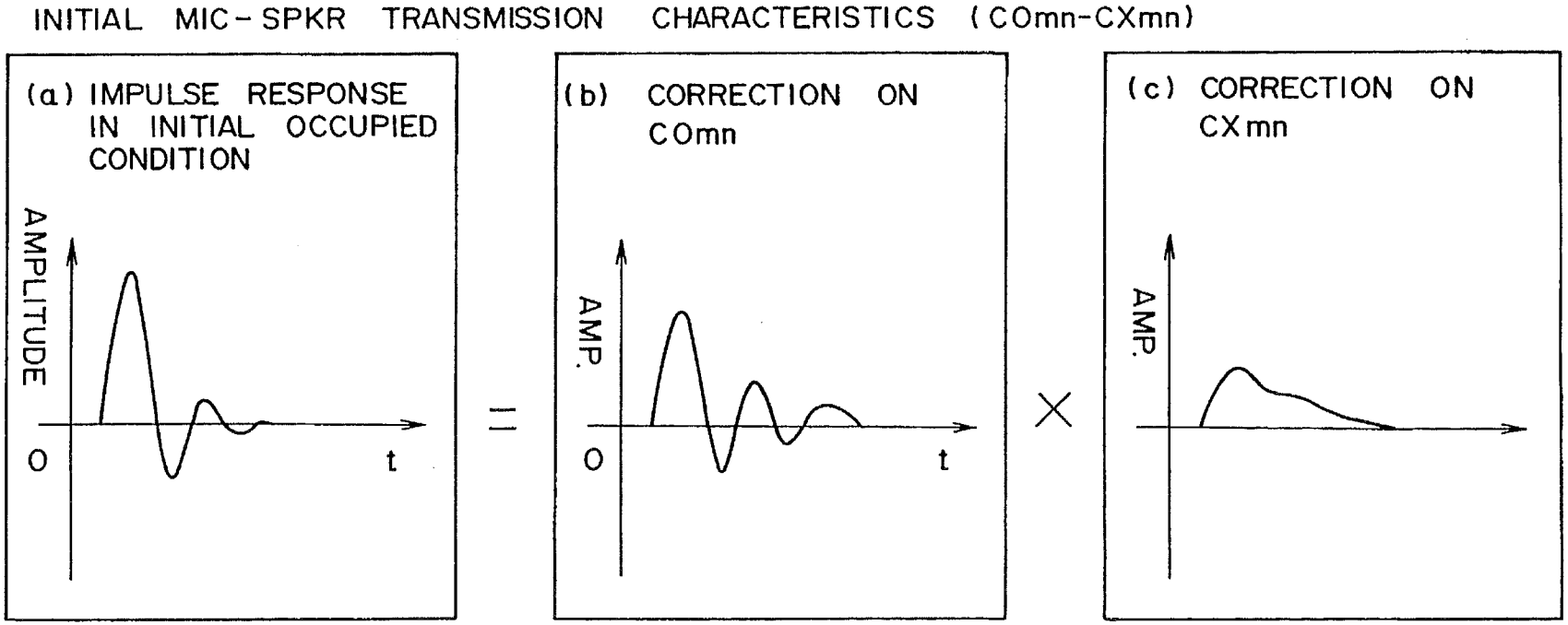
FIGS. 13 and 14 are illustrations for explaining the vacant condition speaker-microphone transmission characteristics and the passenger-influenced transmission characteristics of the third embodiment shown in FIG. 8.
Figure 14:
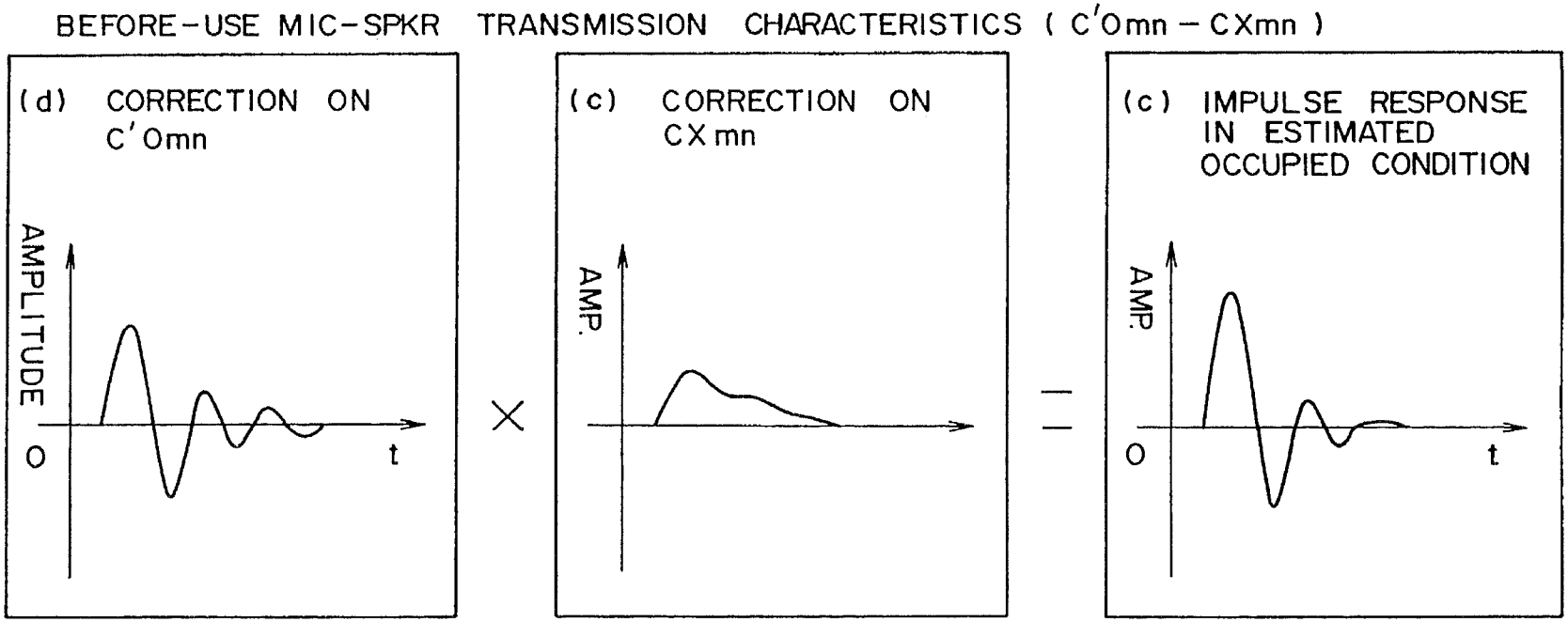

In more detail, as shown in FIGS. 13 and 14, an impulse response under the initial occupied condition is corrected on the basis of both the initial vacant condition speaker-microphone transmission characteristics C0mn and the passenger-influenced characteristics CXmn. Namely, first the initial vacant condition speaker-microphone transmission characteristics C0mn are obtained, and further the passenger-influenced characteristics CXmn are obtained on the basis of the obtained vacant condition transmission characteristics C0mn. These obtained characteristics are previously stored. Further, the speaker-microphone transmission characteristics C'0mn under vacant condition before vehicle use (after shipment) are obtained at any time, and the influence of the passenger is corrected on the basis of the previously stored passenger-influenced characteristics CXmn, thus obtaining accurate speaker-microphone transmission characteristics before the noise reduction system is activated.

The functions of the third embodiment will be described hereinbelow.

As described above, first the speaker-microphone transmission characteristics C011 and C021 between the error microphones 5A and 5B and the speaker 4A under the initial (before shipment) vacant condition and further the speaker-microphone transmission characteristics C012 and C022 between the error microphones 5A and 5B and the speaker 4B under the initial (before shipment) vacant condition have been both obtained on the basis of the system identification. Thereafter, the respective passenger-influenced characteristics CXmn (CX11, CX21, CX12, CX22) according to the various seat-taking conditions (e.g. [only a driver], [a driver and a front passenger]) are obtained by use of the obtained initial vacant condition speaker-microphone transmission characteristics C0mn (C011, C021, C012, C022) on the basis of the system identification. The obtained C0mn are previously stored in the CX storing circuit 23*b*. After shipment, the vacant conditions before the passenger gets on or after the passenger gets off the vehicle are detected, and the before-use (after shipment) vacant condition speaker-microphone transmission characteristics C'011 and C'021 between the error microphones 5A and 5B and the speaker 4A and further the before-use (after shipment) vacant condition speaker-microphone transmission characteristics C'012 and C'022 between the error microphones 5A and 5B and the speaker 4B are obtained on the basis of the system identification. These obtained values are all set to the C'0mn circuits (C'011 circuit 17*a*, C'021 circuit 18*a*, C'012 circuit 18*a*, C'022 circuit 20*a*), respectively.

Thereafter, when a passenger or passengers take a seat or seats, the passenger take-seat discriminating circuit 23*a* of the passenger-influenced characteristics setting circuit 23 discriminates the passenger seat-taking conditions (e.g. [only a driver], [a driver and a front passenger]) on the basis of the signals detected by the seat sensor 24 and 25 disposed inside the seat 26 and 27, respectively. Consequently, the discriminating circuit 23*a* outputs a signal to the CX storing circuit 23*b* to set the passenger-influenced transmission characteristics CXmn (CX11, CX21, CX12, CX22) corresponding to the passenger seat-taking conditions to the CXmn circuit (CX11 circuit 17*b*, CX21 circuit 18*b*, CX12 circuit 19*b*, and Cx22 circuit 20*b*), so that predetermined passenger-influenced characteristics CXmn (CX11, CX21, CX12, CX22) are set to the CX11 circuit 17*b*, CX21 circuit 18*b*, CX12 circuit 19*b* and CX22 circuit 20*b*, respectively.

Once the engine 1 starts, engine vibration noise sound is transmitted via the engine mounts into the passenger compartment as noise. In addition, sound generated during suction and exhaustion strokes is also transmitted into the passenger compartment being multiplied by a predetermined vehicle body transmission characteristics C. Accordingly, transmitted noise sound reaches the noise receiving points determined near the ears of the front passenger on the front passenger seat 26 and the driver on the driver seat 27. At the same time, the engine signals (obtained by waveform-shaping and processing the ignition pulse signal, fuel injection pulse signal, crank angle sensor signal, etc. so as to include engine speed and load information data) and the primary source signal PSe (high in correlation to the engine-related passenger compartment vibration noise sound) are both supplied to the adaptive filters 3A and 3B and the speaker-microphone transmission characteristic estimating circuits 17, 18, 19 and 20, respectively.

The adaptive filter 3A calculates the sum of convolution products of the primary source signal PSe inputted thereto and the filter coefficients, and further outputs the calculated sum as the cancel signal for canceling the vibration noise sound at the noise receiving points, to the speaker 4A, for instance via the D/A convertor and the amplifier (both not shown). At this moment, the canceling sound generated by the speaker 4A is multiplied by the speaker-microphone transmission characteristics Cmn (C11, C21). The multiplied sound reaches the noise receiving point. Similarly, the adaptive filter 3B calculates the sum of convolution products of the primary source signal PSe inputted thereto and the filter coefficients, and further outputs the calculated sum as the cancel signal for canceling the vibration noise sound at the noise receiving points, to the speaker 4B, for instance via the D/A convertor and the amplifier (both not shown). At this moment, the canceling sound generated by the speaker 4B is multiplied by the speaker-microphone transmission characteristics Cmn (C12, C22). The multiplied sound reaches the noise receiving point.

Consequently, at the noise receiving points, the engine-related vibration noise sound and the canceling sound interferes with each other to reduce the vibration noise. At the same time, the interference results between the vibration noise sound and the canceling sound are detected, and the detected results are transmitted to the LMS calculating circuits 6A and 6B, respectively as error signals.

Further, the primary source signal PSe inputted to the speaker-microphone transmission characteristic estimating circuit 17 is corrected by the C'011 circuit 17*a* and the CX11 circuit 17*b*. The primary source signal PSe inputted to the speaker-microphone transmission characteristic estimating circuit 18 is corrected by the C'021 circuit 18*a* and the CX21 circuit 18*b*. Both the corrected signals are given to the LMS calculating circuit 6A. The LMS calculating circuit 6A calculates the filter correction rate on the basis of the error signals supplied from the error microphones 5A and 5B and the primary source signals corrected by the speaker-microphone transmission characteristic estimating circuits 17 and 18, and further executes an algorithm for updating the filter coefficients of the adaptive filter 3A so as to minimize the error signals received by the error microphones 5A and 5B.

Further, the primary source signal PSe inputted to the speaker-microphone transmission characteristic estimating circuit 19 is corrected by the C'012 circuit 19*a* and the CX12 circuit 19*b*. The primary source signal PSe inputted to the speaker-microphone transmission characteristic estimating circuit 20 is corrected by the C'022 circuit 20*a* and the CX22 circuit 20*b*. Both the corrected signals are given to the LMS calculating circuit 6B. The LMS calculating circuit 6B calculates the instantaneous squares of errors on the basis of the error signal supplied from the error microphones 5A and 5B and the primary source signals corrected by the speaker-microphone transmission characteristic estimating circuits 19 and 20, and further executes an algorithm for updating the filter coefficients of the adaptive filter 3B so as to minimize the error signals received by the error microphones 5A and 5B.

As described above, in this embodiment, the system identification is executed at any time whenever passengers are absent within the vehicle, to obtain and set the influence of vehicle interior environment (room temperature, room humidity, changes in temperature and humidity with the passage of time, the appliance arrangement, etc. except due to passengers) upon the speaker-microphone transmission characteristics. Further, the influence of the passenger' seat-taking conditions upon the speaker-microphone transmission characteristics are previously stored as the passenger-influenced characteristics. When passengers take seats, the passenger-influenced characteristics are set in correspondence to the passenger seat-taking conditions. That is, since the speaker-microphone transmission characteristics are set and random noise sound is generated through the speakers when no passengers are present, it is possible to set the transmission characteristics without providing any unpleasant feeling to the passengers.

Further, since the system identification is executed, only when the passenger is absent, to obtain and set the influence of the interior environment (compartment temperature, room humidity, changes in temperature and humidity with the passage of time, appliance arrangement, etc. other than the passengers) upon the speaker-microphone transmission characteristics, it is possible to accurately obtain the speaker-microphone transmission characteristics changeable according to the vehicle interior environment, thus enabling an effective and stable noise reduction.

Further, in the above-mentioned embodiment, the MEFX-LMS (multiple error filtered X-LMS) algorithm obtained by expanding the two-microphone and two-speaker LMS algorithm to the multiple channels has been adopted for the noise reduction system according to the present invention by way of example. Without being limited thereto, the present invention can be also applied to the noise reduction system which uses another MEFX-LMS algorithm (e.g. four error microphone and two speakers) or a single channel algorithm (one microphone and one speaker).

Figure 16:
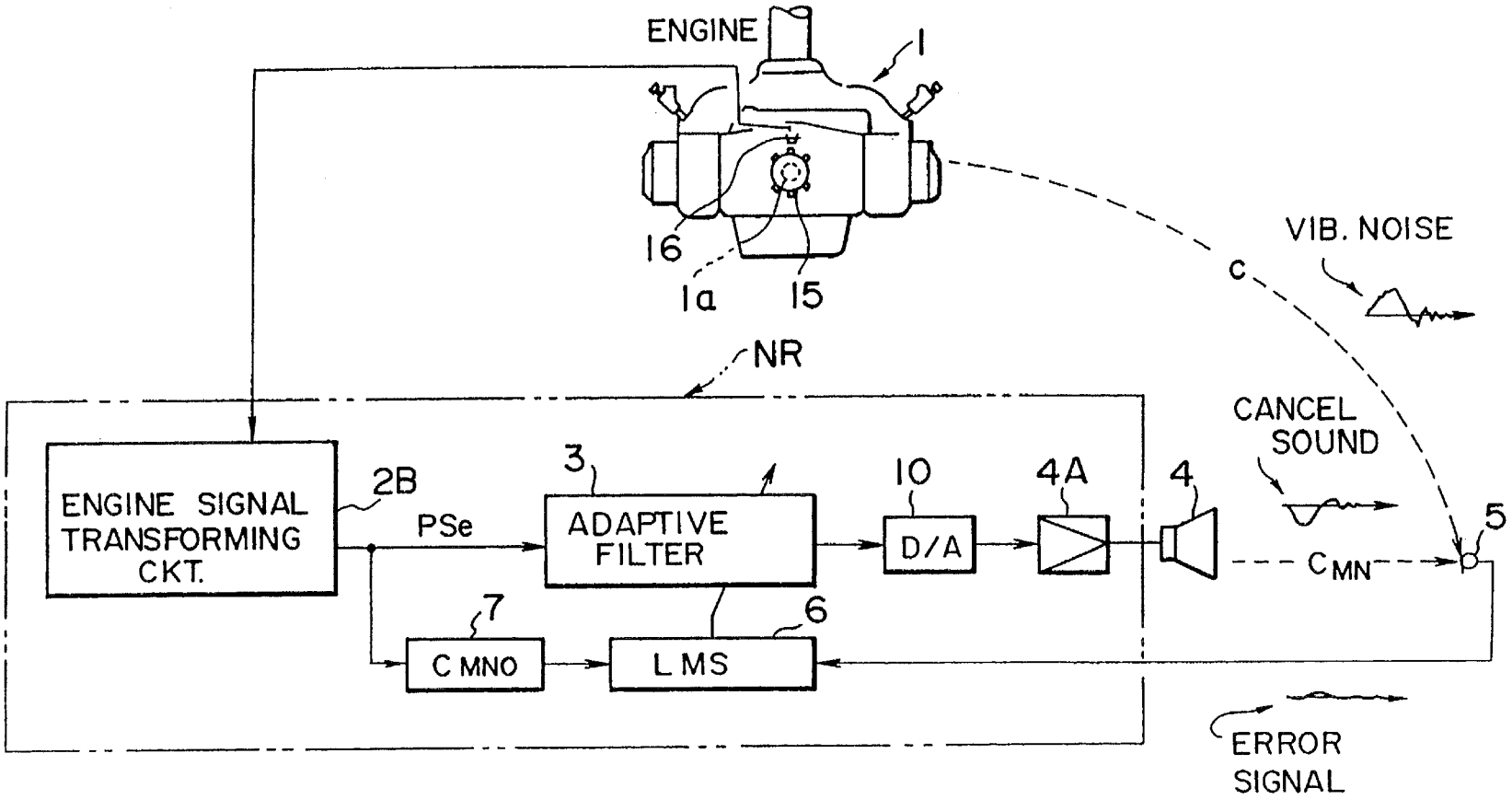
FIG. 16 is a schematic block diagram showing the system operation principle of a fourth embodiment of the noise reduction system according to the present invention.

The fourth embodiment of the noise reduction system of the present invention will be described hereinbelow with reference to FIG. 16. The feature of this embodiment is not to reduce all the engine noise components but to generate specific engine noise according to the preference of the driver or the passenger for providing a comfortable drive feeling.

In the drawing, a crank angle detecting rotor 15 is attached to a crankshaft 1*a* of the engine 1, and further a crank angle sensor 16 of an electromagnetic pickup type for instance, for detecting projections of the rotor 15 is disposed near the outer circumferential surface of the crank angle detecting rotor 15. The crank angle sensor 16 generates 24 pulse signals, for instance for each two engine revolutions (720 degrees CA). The generated pulse signals are inputted to a signal transforming circuit 2B (i.e. the signal transforming means M1) of the noise reduction system NR as a correlation signal.

Figure 17:
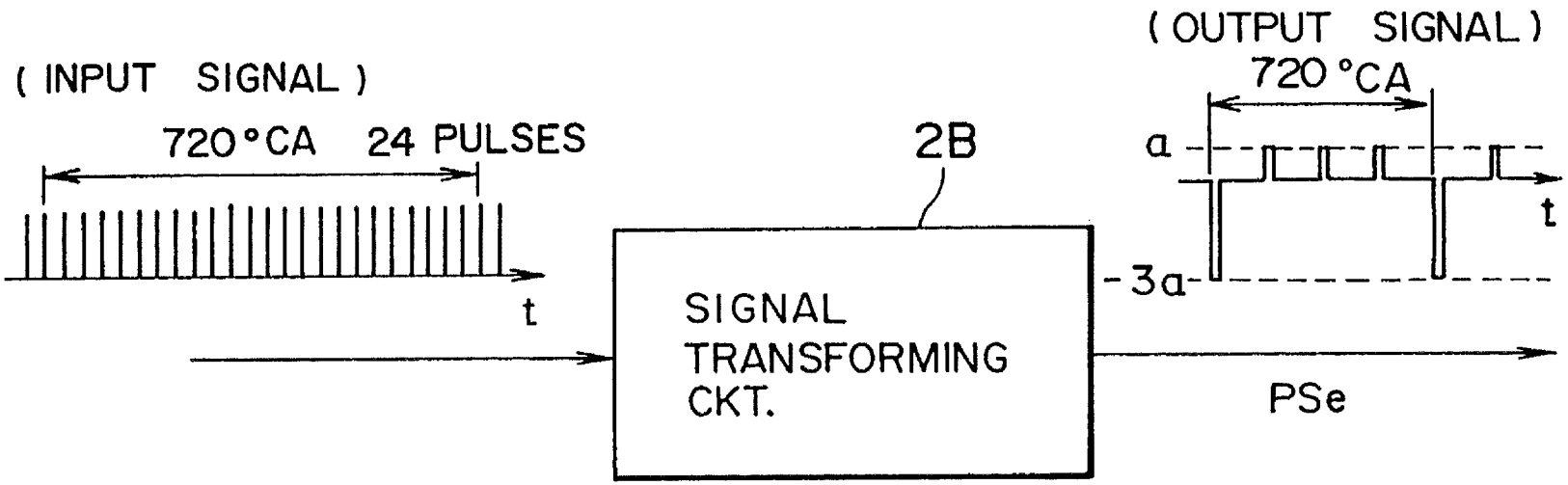
FIG. 17 is a block diagram showing the signal transforming circuit of the fourth embodiment of the present invention.

As shown in FIG. 17, the signal transforming circuit 2B waveform-shapes and processes the correlation signal supplied from the crank angle sensor 16 in order to output a vibration noise source signal (the primary source signal) PSe. The obtained primary source signal PSe is outputted to an adaptive filter 3 and a speaker-microphone transmission characteristic estimating circuit (CMNO circuit) 7 (i.e. the cancel signal updating means M5). Further, in the signal transforming circuit 2B, a plurality of output signals are previously set so as to be freely selectable or switchable through an operation board (not shown). The output signals previously set in the signal transforming circuit 2B are all synchronized with the engine revolutions and classified according to the frequency ranges as follows:

Signal from which 1.5×n (integers) order frequency spectrum components are eliminated as shown by (I) in FIG. 18;

Signal from which 2.0×n (integers) order frequency spectrum components are eliminated as shown by (II) in FIG. 18;

Signal from which 3.0×n (integers) order frequency spectrum components are eliminated as shown by (III) in FIG. 18; and and Signal from which 4.0×n (integers) order frequency spectrum components are eliminated as shown by (IV) in FIG. 18.

As already described, the 4-cycle engine-related vibration noise sound is a vibration noise signal having a period corresponding to two engine revolutions, whose frequency spectrum is composed of a fundamental harmonic (wave) of 0.5 order component of the number of engine revolutions (sine wave component of one cycle per two engine revolutions) and higher harmonics (waves) of high (0.5×n) order components of the number of engine revolutions. However, there exists the case where noise signal has a frequency spectrum composed mainly of specific higher order components according to the number of engine cylinders (e.g. in the case of a four-cylinder engine, the noise signal has a frequency spectrum composed of 2.0×n order components of the number of engine revolutions). Therefore, in this embodiment, the noise reduction system is modified that the engine vibration noise sound of specific numbers of engine cylinders can be heard according to the preference of the driver or the passenger. Further, in this embodiment, the engine noise sounds of four different cylinders can be selected according to the passenger's preference. Without being limited to only four kinds, however, it is of course possible to select other engine noise sounds of other numbers of cylinders (e.g. 12 cylinder engine noise).

The principle of elimination of the specific frequency spectrum components by use of the signal transforming circuit 2B of this embodiment will be described hereinbelow with reference to FIGS. 19(A), 19(A'), 19(B). 19(B'), 20(C) and 20(C').

The Fourier transformation of an impulse function train of regular intervals can be expressed on the basis of an impulse train of the same regular intervals as follows:

$$h(t)=\sum_{n=-\infty}^{\infty}\delta(t-nT)\longleftrightarrow H(f)=(1/T)\sum_{n=-\infty}^{\infty}\delta(f-n/T) \quad (1)$$

where n denotes an integer, t denotes the time, f denotes a frequency, and T denotes a period.

Here, since the impulse function can be expressed as $$\delta(0)=1$$
$$\delta(t)=0 \qquad (t\neq 0)$$

The above equation (1) can be expressed as follows:

$$h(t)=1 \qquad (t=nT)$$
$$h(t)=0 \qquad (t\neq nT)$$
$$H(f)=1/T \qquad (f=n/T)$$
$$H(f)=0 \qquad (f=n/T)$$

Therefore, the impulse function train having a period T and an amplitude a as shown in the time region of FIG. 19(A) can be represented by an impulse train having a frequency spectrum of 1/T higher order components and an amplitude of a/T as shown in the frequency region in FIG. 19(A').

Further, when the magnitude of the impulse is multiplied by K times, since the magnitude of the spectrum is also multiplied by K times, the impulse function train having a period K×T and an amplitude −K×a as shown in the time region of FIG. 19(B) can be represented by an impulse train having a frequency spectrum of 1/(K×T) higher order components and an amplitude of −a/T as shown in the frequency region in FIG. 19(B').

Here, when the signals represented by the above-mentioned FIG. 19(A), FIG. 19(A'), FIG. 19(B), and FIG. 19(B') are synthesized at the time and frequency regions, respectively, the signal becomes impulses with an amplitude −(K−1).a for each period of K×T and the impulses with an amplitude a for each period of n×T (n: integers) other than the period of K×T., as shown in the time region of FIG. 20(C). Further, as shown in the frequency region of FIG. 20(C'), since the n/T order components of the frequency spectrum are eliminated, a frequency spectrum of 1/K×T higher order components other than the above can be expressed as an impulse train having an amplitude −a/T.

Accordingly, when the frequency spectrum component of noise sound corresponding to a S-cylinder engine of four cycles per two engine revolutions (720 degrees CA) is required to be eliminated from the noise source signal (to hear the engine noise), the noise sound is a signal of one period per two engine revolutions and therefore the engine vibration noise sound has a frequency spectrum composed of 0.5×n components. In addition, each of the S-cylinders has a period of 720 degrees CA. Consequently, if K=S, $$1/K\times T=1/2$$

so that the following relationship can be obtained $$K\times T=S\times T=2 \quad (2)$$

On the basis of the above-mentioned expression, it is possible to obtain primary noise source sound from which the frequency spectrum component of the S-cylinder engine is eliminated, by outputting S-piece pulses generated at regular time intervals of 720 degrees CA in such a way that one pulse having an amplitude (S-1) times larger than that of the other remaining (S-1) piece pulses is generated in the direction opposite to that of the other remaining pulses. The generated sound is determined as the vibration noise source signal (the primary source signal), and outputted in synchronism with the engine revolutions, thus it being possible to selectively obtain an engine sound of a specific number of cylinders.

The operation of this embodiment will be described hereinbelow.

The signal (e.g. 24 pulses per two engine revolutions (720 degrees CA)) detected by the crank angle sensor 16 of the engine 1 is inputted to the signal transforming circuit 2B of the noise reduction system NR. Here, if the driver, for instance operates the operation board so that noise sound of a four-cylinder engine can be heard, the signal transforming circuit 2B processes the signal of the crank angle sensor 16 into the signal as follows: four pulses are generated at regular intervals of 720 degrees CA in such a way that one pulse having an amplitude 3 times larger than that of the other remaining 3 piece pulses is generated in the direction opposite to that of the other remaining pulses with respect to the time region and additionally 2.0×n (integers) order components are eliminated from the frequency spectrum components with respect to the frequency range. The generated noise sound is determined as the vibration noise source signal (the primary source signal), and outputted to the adaptive filter 3 and the speaker-microphone transmission characteristic estimating circuit (CMN0) circuit 7.

Further, where the noise reduction system according to the present invention is combined with other noise control apparatus (e.g. muffler), it is possible to provide a pleasant sound to the driver and the passengers, while reducing noise sound generated in the external environment outside the vehicle.

Further, in the present embodiment, although the crank angle sensor is adopted as the correlation signal detecting means, it is of course possible to adopt other detecting means such as cam angle sensor as the correlation signal detecting means or to input other correlation signals (e.g. ignition pulse signal, fuel injection pulse signal, etc.) to the signal transforming means as the correlation signal.

Further, when the engine load information data (e.g. intake air amount, throttle opening rate, etc.) are inputted to the signal transforming means, since the correlation to the engine vibration noise can be further improved, it is possible to realize a passenger compartment bass sound control apparatus high in response characteristics during transient operation of the engine, in particular.

As described above, in the embodiments of the present invention, since the driver or passengers can obtain pleasant sound, without canceling specific higher order components of the frequency spectrum of the engine vibration noise, it is possible to provide a comfortable driving feeling to the driver and the passengers.

While the presently preferred embodiments of the present invention have been shown and described, it is to be understood that these disclosures are for the purpose of illustration and that various changes and modifications may be made without departing from the scope of the invention as set forth in the appended claims.

What is claimed is:

1. A noise reduction system for an automobile compartment, comprising:

pulse generating means for generating a first pulse train in synchronism with rotation of an engine;

engine load detecting means for detecting engine load during operation of an engine;

signal transforming means for transforming said first pulse train to obtain a second pulse train having a frequency spectrum composed of predetermined order components corresponding to the rotation, and for varying an amplitude of said second pulse train according to said detected engine load, so as to generate a primary source signal;

an adaptive filter for synthesizing impulse response in response to said primary source signal to produce a noise cancel signal, said adaptive filter having filter coefficients characterizing said impulse responses;

sound generating means for generating cancel sound corresponding to said noise cancel signal, so as to cancel noise within said compartment;

receiving means for receiving said noise and said cancel sound and for producing an error signal representing the error resulting from interference between said noise and said cancel sound; and updating means responsive to said error signal for updating said filter coefficients so as to minimize the error between said vibration noise and said cancel sound.

2. The noise reduction system according to claim 1, wherein said engine load detecting means has intake air amount detecting means for detecting an intake air amount.

3. The noise reduction system according to claim 1, wherein said pulse generating means has ignition signal generating means for generating a plurality of ignition pulses every two revolutions of an engine.

4. The noise reduction system according to claim 1, wherein said pulse generating means has fuel injection pulse signal generating means for generating a plurality of fuel injection pulses.

5. The noise reduction system according to claim 1, wherein said pulse generating means has crank angle sensor for generating a plurality of crank angle pulses for every two revolutions of an engine, each pulse representing a corresponding crank angle.

6. The noise reduction system according to claim 1, wherein said pulse generating means has an engine cam angle sensor for generating a plurality of pulses for every two revolutions of an engine, each pulse representing a corresponding cam angle.

7. The noise reduction system according to claim 1, wherein said engine load detecting means has an engine intake pipe vacuum sensor for detecting engine intake pipe vacuum.

8. The noise reduction system according to claim 1, wherein said engine load detecting means has a throttle valve opening sensor for detecting a throttle valve opening of an engine.

9. A noise reduction system for an automobile compartment, comprising:

pulse generating means for generating a first pulse train in synchronism with rotation of an engine;

signal transforming means for transforming said first pulse train to obtain a second pulse train having a frequency spectrum composed of 0.5×n order components corresponding to the frequency of rotation, where n denotes integers, so as to generate a primary source signal;

an adaptive filter for synthesizing impulse responses in response to said primary source signal to produce a noise cancel signal, said adaptive filter having filter coefficients characterizing said impulse responses;

sound generating means for generating cancel sound corresponding to said noise cancel signal, so as to cancel noise within said compartment;

receiving means for receiving said noise and said cancel sound and for producing an error signal representing the error resulting from interference between said noise and said cancel sound; and updating means responsive to said error signal for updating said filter coefficients so as to minimize the error between said noise and said cancel sound, said updating means including a correcting circuit for previously storing transmission characteristics between said sound generating means and said error signal receiving means, and for correcting said primary source signal in accordance with the stored transmission characteristics, and a least means square calculating circuit for calculating an instantaneous square of a difference between the corrected primary source signal and the received error signal, and for updating the filter coefficients of the adaptive filter on the basis of the calculated instantaneous square of the difference so that the error signal can be minimized.

10. A noise reduction system for an automobile compartment, comprising:

pulse generating means for generating a first pulse train in synchronism with rotation of an engine;

signal transforming means for transforming said first pulse train to obtain a second pulse train having a frequency spectrum composed of 0.5×n order components corresponding to the frequency of rotation, where n denotes integers, so as to generate a primary source signal;

an adaptive filter for synthesizing impulse responses in response to said primary source signal to produce a noise cancel signal, said adaptive filter having filter coefficients characterizing said impulse responses;

sound generating means for generating cancel sound corresponding to said noise cancel signal, so as to cancel noise within said compartment;

receiving means for receiving said noise and said cancel sound and for producing an error signal representing the error resulting from interference between said noise and said cancel sound;

updating means responsive to said error signal for updating said filter coefficients so as to minimize the error between said noise and said cancel sound;

first transmission characteristic providing means for providing first transmission characteristics of transmission between said sound generating means and said error signal receiving means for a condition when said compartment is vacant;

seat sensing means for detecting a presence of a passenger on at least one seat and outputting a passenger presence signal;

discriminating means responsive to the passenger presence signal for discriminating a passenger seat taking condition;

storing means for storing a plurality of predetermined second transmission characteristics provided to compensate for a change of actual transmission characteristics in the compartment from said first transmission characteristics in response to said passenger seat taking condition; and second transmission characteristics providing means for providing one of said second predetermined transmission characteristics stored in said storing means in response to the discriminated passenger seat taking condition; wherein said updating means updates said filter coefficients based on a corrected primary source signal corrected by both said first predetermined transmission characteristics and said one of said second predetermined transmission characteristics.

11. A noise reduction system for an automobile compartment, comprising:

pulse generating means for generating a first pulse train in synchronism with rotation of an engine;

signal transforming means for transforming said first pulse train to obtain a second pulse train having a frequency spectrum composed of 0.5×n-order components corresponding to a frequency of engine revolutions from which specific higher harmonics are selectively removed, where n denotes integers, so as to generate a primary source signal corresponding to an engine vibration sound produced by an engine having particular number S of cylinders;

an adaptive filter for synthesizing impulse responses in response to said primary source signal to produce a noise cancel signal, said adaptive filter having filter coefficients characterizing said impulse responses;

sound generating means for generating cancel sound corresponding to said noise cancel signal, so as to leave noise within said compartment which is similar to sound produced by an engine having S number of cylinders;

receiving means for receiving said noise and said cancel sound and for producing an error signal representing the error resulting from the interference between said noise and said cancel sound; and updating means responsive to said error signal for updating said filter coefficients so as to minimize the error between said noise and said cancel sound.

12. The noise reduction system according to claim 11, further including:

engine load detecting means for detecting engine load during operation of an engine, wherein said signal transforming means is adapted to vary the amplitude of said second pulse train according to said detected engine load.

13. The noise reduction system according to claim 11, wherein said second pulse train is composed of S-number of pulses generated at regular intervals for two cycles of an engine in such a way that one pulse having an amplitude (S-1) times larger than that of the other remaining pulses is generated in a direction opposite to that of the other remaining pulses.

14. A noise reduction system for an automobile compartment, comprising:

pulse generating means for generating a first pulse train in synchronism with rotation of an engine;

signal transforming means for transforming said first pulse train to obtain a second pulse train having a frequency spectrum composed of predetermined order components corresponding to the rotation so as to generate a primary source signal;

an adaptive filter for synthesizing impulse responses in response to said primary source signal to produce a noise cancel signal, said adaptive filter having filter coefficients characterizing said impulse responses;

sound generating means for generating cancel sound corresponding to said noise cancel signal, so as to cancel noise within said compartment;

receiving means for receiving said noise and said cancel sound and for producing an error signal representing the error resulting from interference between the noise and the cancel sound;

updating means responsive to said error signal for updating said filter coefficients so as to minimize the error between said noise and said cancel sound;

first transmission characteristics providing means for providing first transmission characteristics of transmission between said sound generating means and said receiving means for a condition when the compartment is vacant;

seat sensing means for detecting a presence of a passenger on at least one seat and outputting a passenger presence signal;

discriminating means responsive to said passenger presence signal for discriminating a passenger seat taking condition;

storing means for previously storing a plurality of predetermined second transmission characteristics provided to compensate for a change of actual transmission characteristics in the compartment from said first transmission characteristics, depending on said passenger seat taking condition; and second transmission characteristic providing means for providing one of said second predetermined transmission characteristics stored in said storing means in response to the discriminated passenger seat taking condition; wherein said updating means updates said filter coefficients based on a corrected primary source signal corrected by both said first predetermined transmission characteristic and said one of said second predetermined transmission characteristics.

15. The noise reduction system according to claim 14, wherein said seat sensing means includes a first sensor provided on a driver seat to detect a presence of a driver and a second sensor provided on a passenger seat to detect a presence of a passenger thereon, whereby said storing means stores a first value and a second value as said second predetermined transmission characteristics, said first value corresponding to the presence of both driver and passenger.

16. The noise reduction system according to claim 15, wherein said seat sensing means further includes sensors on a rear seat to detect a presence of any passengers thereon, and thereby to specify seats occupied by passengers for the selection of a value from said second predetermined transmission characteristics.

17. The noise reduction system according to claim 14 further including an initial transmission characteristics setting system for initially determining said first transmission characteristics to be actual transmission characteristics before shipment of an automobile having said noise reduction system.

18. The noise reduction system according to claim 17, wherein said initial transmission characteristics setting system further initially determines said second predetermined transmission characteristics such that each of said second predetermined transmission characteristics corresponds to the change of actual transmission characteristics from said first transmission characteristics in each seat taking condition.

19. The noise reduction system according to claim 17, further comprising:

means for correcting said first predetermined transmission characteristics when the compartment is vacant after shipment of the automobile to compensate for change of environment in the compartment.

20. A noise reduction system for an automobile compartment, comprising:

pulse generating means for generating a first pulse train in synchronism with rotation of an engine;

engine load detecting means for detecting engine load during operation of an engine;

signal transforming means for transforming said first pulse train to obtain a second pulse train having a frequency spectrum composed of predetermined order components corresponding to the frequency of rotation, and for varying the amplitude of said second pulse train according to said detected engine load so as to generate a primary source signal;

an adaptive filter for synthesizing impulse responses in response to said primary source signal to produce a noise cancel signal, said adaptive filter having filter coefficients characterizing said impulse responses;

sound generating means for generating cancel sound corresponding to said noise cancel signal, so as to cancel noise within said compartment;

receiving means for receiving said noise and said cancel sound and for producing an error signal representing the error resulting from interference between said noise and said cancel sound; and updating means responsive to said error signal for updating said filter coefficients so as to minimize the error between said noise and said cancel sound, wherein said transforming means transforms said first pulse train into said second pulse train such that said second pulse train has a frequency spectrum composed of $0.5 \times n$ order components corresponding to the frequency of rotation, where n denotes integers, from which specific higher order harmonics are selectively removed such that said cancel sound cancels noise within said compartment so as to leave noise as generated by an engine having a particular number S of cylinders.

21. The noise reduction system according to claim 20, wherein said second pulse train is composed of S-number of pulses generated at regular intervals for two cycles of an engine in such a way that one pulse having an amplitude (S-1) times larger than that of the other remaining pulses is generated in a direction opposite to that of the other remaining pulses.

22. A noise reduction system for decreasing a noise in a passenger compartment of an automobile having, engine speed detecting means for sensing an engine speed and for generating an engine speed pulse train signal, and engine load detecting means for discriminating an engine load at any operating conditions and for producing an engine load signal, the system comprising:

signal transforming means responsive to said pulse train signal for transforming said signal into a pulse train waveformed and composed of a plurality of components represented by an amplitude spectrum in accordance with said engine load and for generating a primary source signal;

an adaptive filter responsive to said primary source signal for synthesizing said pulse train by a convolution summing with a filter coefficient and for producing a noise cancel signal;

sound generating means responsive to said noise cancel signal for amplifying into an audible sound and for generating a cancel sound signal in order to cancel said primary source signal;

receiving means responsive to said primary source and cancel sound signals for detecting an interference therebetween and for transmitting an error signal; and updating means responsive to said error signal for updating said filter coefficient so as to effectively minimize said noise by said interference.

23. A noise reduction system for decreasing a noise in a passenger compartment of an automobile having, engine speed detecting means for sensing an engine speed and for generating an engine speed pulse train signal, and seat occupancy discriminating means for discriminating whether at least one seat in occupied by a passenger and for producing a seat occupancy signal, the system comprising:

signal transforming means responsive to said engine speed pulse train signal for transforming said signal into a pulse train waveformed and composed of a plurality of components represented by a frequency spectrum in accordance with said engine speed and for generating a primary source signal;

an adaptive filter responsive to said primary source signal for synthesizing said pulse train by a convolution summing with a filter coefficient and for producing a noise cancel signal;

sound generating means responsive to said noise cancel signal for amplifying the noise cancel signal into an audible sound and for generating a cancel sound signal in order to cancel said primary source signal;

receiving means responsive to said primary source and cancel sound signals for detecting an interference therebetween and for transmitting an error signal;

first setting means responsive to said seat occupancy signal for deciding first characteristics of signal transmission between said sound generating means and said receiving means when there is no passenger in said compartment and for generating a vacancy characteristics signal;

storing means responsive to said vacancy characteristics signal for previously storing a second characteristics effected by seating of said passenger to said first characteristics of signal transmission and for producing an occupancy signal;

second setting means responsive to said occupancy signal for calculating influential characteristics of said passenger to said first characteristics of signal transmission and for outputting an occupancy influential signal;

correcting means responsive to said vacancy characteristics signal and said occupancy influential signal for correcting said primary source signal and for generating a corrected signal;

updating means responsive to said error signal and said corrected signal for updating said filter coefficient so as to effectively minimize said noise by said interference.

24. A noise reduction system for decreasing a noise in a passenger compartment of an automobile having, engine speed detecting means for sensing an engine speed and for generating an engine speed pulse train signal, and engine load detecting means for discriminating an engine load at any operation conditions and for producing an engine load signal, the system comprising:

signal transforming means responsive to said pulse train signal for transforming said signal into a pulse train waveformed and composed of a plurality of components by selecting a frequency spectrum without including a predetermined high level component of said frequency spectrum corresponding to a cylinder number of said engine and for generating a primary source signal;

an adaptive filter responsive to said primary source signal for synthesizing said pulse train by a convolution summing with a filter coefficient and for producing a noise cancel signal;

sound generating means responsive to said noise cancel signal for amplifying the noise cancel signal into an audible sound and for generating a cancel sound signal in order to cancel said primary source signal;

receiving means responsive to said primary source and cancel sound signals for detecting an interference therebetween and for transmitting an error signal; and updating means responsive to said error signal for updating said filter coefficient so as to effectively minimize said noise.

* * * * *